US009811981B2

(12) United States Patent
Trepp et al.

(10) Patent No.: US 9,811,981 B2
(45) Date of Patent: Nov. 7, 2017

(54) GAMES OF CHANCE

(71) Applicant: Trepp Enterprises, Inc., Reno, NV (US)

(72) Inventors: Warren Trepp, Reno, NV (US); James R. Sullivan, St. Augustine, FL (US); John M. Hammond, Livonia, NY (US)

(73) Assignee: Trepp Enterprises, Inc., Reno, NV (US)

( * ) Notice: Subject to any disclaimer, the term of this patent is extended or adjusted under 35 U.S.C. 154(b) by 0 days.

(21) Appl. No.: 15/276,883

(22) Filed: Sep. 27, 2016

(65) Prior Publication Data

US 2017/0039814 A1 Feb. 9, 2017

Related U.S. Application Data

(63) Continuation of application No. PCT/US2016/038175, filed on Jun. 17, 2016.

(60) Provisional application No. 62/306,547, filed on Mar. 10, 2016, provisional application No. 62/182,100, filed on Jun. 19, 2015.

(51) Int. Cl.
*G07F 17/32* (2006.01)

(52) U.S. Cl.
CPC ..... *G07F 17/3293* (2013.01); *G07F 17/3209* (2013.01); *G07F 17/3211* (2013.01); *G07F 17/3213* (2013.01); *G07F 17/3258* (2013.01); *G07F 17/3262* (2013.01)

(58) Field of Classification Search
CPC ..... G07F 17/3293; A63F 3/00157
See application file for complete search history.

(56) References Cited

U.S. PATENT DOCUMENTS 5,607,162 A * 3/1997 Boylan ..... A63F 3/00157 273/274
5,720,484 A * 2/1998 Hsu ..... A63F 3/00157 273/274
5,732,949 A * 3/1998 Josephs ..... A63F 1/00 273/292

(Continued)

OTHER PUBLICATIONS

International Search Report in PCT Appl. No. U52016/038175 dated Jan. 26, 2017. EFS file name: 20170207_15-276883_IDS_NPL_Cite1.

(Continued)

*Primary Examiner* — Steven J Hylinski
(74) *Attorney, Agent, or Firm* — John M. Hammond; Patent Innovations LLC

(57) ABSTRACT

Games of chance are disclosed. In a general embodiment, collections of objects used in the game are defined. The values of objects of the collection are ranked according to a predefined hierarchy. A first object collection is assigned to a Player party. The Dealer accepts a wager from the Player on certain outcomes of random selections of a subset of the collection of objects corresponding to high value objects. A random selection of a subset of objects is made. The subset is compared to predefined high value objects. If there is no matching relationship between the subset and the high value objects, the wager is retained by the Dealer. If there is a matching relationship but not reaching a threshold level of matching, the Dealer pays funds to the Player. If the matching exceeds a threshold level, the Player may accept the payout or wager further.

11 Claims, 7 Drawing Sheets

(56) References Cited

U.S. PATENT DOCUMENTS 5,743,800 A * 4/1998 Huard ..... A63F 3/00157 463/12
5,762,552 A * 6/1998 Vuong ..... G07F 17/32 463/17
5,770,533 A * 6/1998 Franchi ..... G07F 17/32 463/16
5,779,546 A * 7/1998 Meissner ..... A63F 1/14 273/148 A
5,839,955 A * 11/1998 Mangano ..... A63F 5/04 463/16
5,876,283 A * 3/1999 Parra ..... A63F 3/00157 273/292
6,000,699 A * 12/1999 Long ..... A63F 1/00 273/292
6,004,205 A * 12/1999 Lauretta ..... A63F 3/00157 273/292
6,158,741 A * 12/2000 Koelling ..... A63F 3/00157 273/292
6,164,652 A * 12/2000 Lauretta ..... A63F 3/00157 273/273
6,227,969 B1 * 5/2001 Yoseloff ..... A63F 1/18 273/143 R
6,357,749 B1 3/2002 Feola
6,651,984 B1 11/2003 Luken
6,834,857 B2 12/2004 Lee et al.
7,179,167 B2 2/2007 deKeller
7,520,509 B1 4/2009 Haber
7,727,060 B2 * 6/2010 Mills ..... A63F 1/00 273/292
7,789,750 B2 9/2010 Marks et al.
8,517,820 B2 8/2013 Schwartz et al.
8,608,543 B2 12/2013 Cuddy et al.
9,189,927 B2 11/2015 Cuddy et al.
9,230,398 B2 * 1/2016 Chun ..... G07F 17/3225
2002/0068635 A1 * 6/2002 Hill ..... A63F 1/14 463/47
2002/0151339 A1 10/2002 Huang
2004/0066001 A1 4/2004 Duncombe et al.
2005/0153767 A1 7/2005 Gauselmann
2007/0035090 A1 2/2007 Cheng
2007/0063442 A1 3/2007 Kenny et al.
2009/0026707 A1 1/2009 Lo
2009/0325667 A1 12/2009 Weber
2010/0197387 A1 8/2010 Lind et al.
2012/0094752 A1 4/2012 Cannon
2012/0112413 A1 5/2012 Hodgson et al.
2012/0119442 A1 5/2012 Ma
2013/0095902 A1 4/2013 Smith et al.
2014/0094233 A1 4/2014 Storm
2014/0206435 A1 7/2014 Toohey
2015/0072754 A1 3/2015 Mckay et al.
2015/0123344 A1 5/2015 Besser
2016/0035191 A1 2/2016 Cuddy et al.

OTHER PUBLICATIONS

Written Opinion in PCT Appl. No. US2016/038175 dated Jan. 26, 2017. EFS file name: 20170207_15-276883_IDS_NPL_Cite2.

* cited by examiner

GAMES OF CHANCE

CROSS-REFERENCE TO RELATED PATENT APPLICATIONS

This application is a continuation of International Application No. PCT/US2016/038175 filed in the U.S. Receiving Office on Jun. 17, 2016 and designating the United States, which PCT application claims priority from U.S. Provisional Patent Application No. 62/182,100 filed Jun. 19, 2015, and priority from U.S. Provisional Patent Application No. 62/306,547 filed Mar. 10, 2016. The disclosures of all of these patent applications are incorporated herein by reference in their entireties.

BACKGROUND

Technical Field

Games of chance, and in particular, wagering games that may be played in a physical setting such as a casino, or played virtually via execution using a computer.

Description of Related Art

Games of chance have been played for thousands of years, both as a recreational pursuit, and with the intention of winning money, or some other form of consideration. Additionally, commercial enterprises (often referred to as casinos) that offer games of chance have also existed throughout civilization. These enterprises seek to earn money by enticing people to play the games, these players themselves hoping to win money from the casino. On the average, the casinos make money because the odds that they define in the games that they offer favor them.

Games of chance, also referred to herein as gambling games, which are the most successful have attributes of fast play, easy winning rules, high odds of winning, and the possibility of large bonus payouts. These attributes are even more important in present times: in this age of the Internet, smart phones, and digital communication, people have short attention spans, limited understanding of probability and statistics, and the expectation of instant gratification. Accordingly, games with these attributes game will attract a large numbers of players and provide a high rate of return to the gaming provider.

Some traditional casino games like craps, and even more simple games like blackjack, require player strategies that are complicated enough to eliminate many player groups. Younger gamblers prefer more action and higher odds of winning on each bet, with much larger bonus payouts like the "megabucks" style games. To the best of the Applicant's knowledge, there are currently no casino games that fulfill all of these requirements. Accordingly, there remains an unmet need for new wagering games that have the above attributes, in order to satisfy consumers who are partaking in leisure time activities, and parties who play wagering games for profit.

SUMMARY

The present invention meets this need by providing gambling games that are fast to play, easy to learn, and have a high likelihood of a winning Player for each play. Additionally, the games may be operated so as to have a large and growing bonus for each play. Additionally, certain embodiments of the gambling games offer a sequence of decision points to accept an accrued payout, or risk the payout in further play to obtain an even larger payout, in some embodiments, exceeding a billion dollars. After a first successful wager in such a game, a Player is offered the opportunity to accept accrued winnings, i.e., accept "The Deal," or decline to accept the accrued winnings i.e. decide "No Deal," and risk the accrued winnings in an additional play of the game.

The games may be played using a wide variety of objects. In a broad aspect, a game is based on a Player matching randomly selected objects. A Dealer is assigned a first collection of objects, and the Player is assigned a second collection of objects from a group of objects that at least contains the first collection of objects assigned to the Dealer. The Dealer makes a random selection of objects from the first collection, and then the Dealer or Player makes a random selection of objects from the second collection. If the randomly selected objects from the second collection match, at lease to some degree, the first collection of objects, then the Player wins funds based upon a bet that he wagered prior to the random selection. The amount of funds paid out for a win depends upon the "quality" of the match, and the value of the objects, which may be classified according to a predefined hierarchy. Higher quality and higher value matches are of lower odds to occur, and thus have a higher payout.

In another broad aspect, a game is based on a Player randomly selecting objects, and having those objects be desirable objects. In embodiments in which the game is played as a wagering game, when the Player's randomly selected objects are desirable objects, the Player wins a payout of funds on his wager, the amount of which is dependent upon the odds of having selected desirable objects via the random selection.

Prior to playing the game, a collection of objects is defined, and classified according to a predefined hierarchy. Certain members of the collection of objects are defined as being desirable, or of "high quality." If certain objects that are members of the subset of desirable objects are selected in playing the game, the Player may win a payout of funds, depending upon a decision he makes to accept the payout, or continue to play in an attempt to obtain an even greater payout. After defining the objects and their hierarchy, the Player is assigned a collection of the objects. (In embodiments that are played in a casino, although the Player is assigned the collection of objects, a Dealer may retain custody of the objects, i.e., the Dealer physically handles the objects and makes selections of them in accordance with the game procedure.)

To begin play, the Player places a wager, betting on an outcome of the game that is favorable to him. The Player (or the Dealer having custody of the objects) then makes a random selection of a subset of objects from the Player's collection of objects. The selection is made such that the identities of the objects are not known to the Player (or the Dealer). Play then proceeds with a revealing of at least one of the objects. If the revealed randomly selected object is a member of the subset of desirable objects, then the Player may be presented with two options:

Option A: Decide "Deal," i.e., accept a payout of funds based upon the bet that he wagered prior to the random selection. The amount of funds paid out depends upon the "quality" of the match to the objects predefined as desirable, and the respective values of the objects selected that are desirable. Higher quality and higher value matches are of lower odds to occur, and thus have a higher payout.

Option B: Decide "No Deal," i.e. decline the above payout of funds, and elect to continue play in an attempt to attain an even greater payout of funds by having the randomly selected objects continue to match the objects predefined as desirable. In electing this option, the Player risks losing his funds if the next revealed randomly selected object is not a member of the subset of objects that are desirable.

In the above play of the game, if only one of the randomly selected objects has been revealed, then other randomly selected objects remain to be revealed. In this embodiment, then to continue play, another one of the randomly selected objects may be revealed. If the second revealed randomly selected object is a member of the subset of desirable objects, then the Player may again be presented with the above two options. If the Player elects Option A, the payout of funds is increased in inverse proportion to the odds of his having successfully selected and revealed two objects that are members of the subset of desirable objects. In certain embodiments, reveals of the Player's randomly selected objects may continue, until (and if) a threshold combination of winning objects is reached that triggers the offer of Option A or Option B.

The reveals of the Player's randomly selected objects may continue, contingent upon each revealed object being a winning object, such that Options A and B are offered by the House. If at any point, the Player elects Option B, i.e. he wagers his accrued winnings on another successful outcome, and he loses the wager, the House keeps the accrued winnings and the Player's original wager of funds, and the game terminates.

In certain embodiments, if the Player continues with successful outcomes on every play, i.e. the Player's randomly selected objects are members of the predetermined subset of high quality objects, when the final randomly selected Player's object is revealed and is a final predetermined high quality object, the game terminates with the Player winning the maximum possible jackpot. In other embodiments, when the Player is entirely successful in making "Option B" wagers, and the final Player's randomly selected object is revealed and is a final predetermined high quality object, play may then continue using a random selection of objects from a Dealer's collection of objects. The Player may elect Option A, i.e., to take his accrued winnings from the House; or Option B, to wager his accrued winnings upon the next randomly selected object from the Dealer's collection to be a desired high quality object. Play may then continue, as described previously, using the remaining randomly selected Dealer's objects. At each decision point, the Player may elect Option A, to take his accrued winnings, or Option B, to wager his accrued winnings on another successful outcome. At any point, if the Player loses his wager, the House keeps the accrued winnings and the Player's original wager of funds. If the Player continues with successful outcomes on every play, i.e. the Dealer's randomly selected objects are members of the predetermined subset of high quality objects, when the final randomly selected Dealer's object is revealed and is a final predetermined high quality object, the game terminates with the Player winning the maximum possible jackpot. It will be apparent that when the game is played live in a public venue, such as in a casino with spectators and multiple Players playing, that the game will generate excitement as the accrued winnings of one or more Players continues to build. This in turn will entice others to play the game.

In certain embodiments, the games may be played using cards as the objects. The cards may be standard decks of playing cards, comprising the standard four suits, and the standard hierarchy of values, 2-10 and Jack, Queen, King, and Ace. Card embodiments of the game may be played with a variety of combinations of decks of cards. In one embodiment, a single deck of cards may be assigned to the Dealer, and a single deck of cards may be assigned to each Player. In other embodiments, the Dealer may have a stack of cards or a contaner of cards known as a "shoe," containing two or more decks, and each Player may have corresponding decks of cards containing two or more decks. In certain embodiments, prior to playing a series of "hands" in the game, each deck or stack of cards may have a separator card or other place holder placed on the bottom of the deck, or near the bottom or middle of the deck. A series of hands can then be played without shuffling the cards before each hand, and when that card is reached in a dealing of a hand, play is halted, and all cards are shuffled again to place them in a new random order.

In other embodiments, the objects may be marked and/or colored balls or other objects that are randomly mechanically selected by an object selecting apparatus. In other embodiments, the objects may be randomly mechanically selected from spinning dials or wheels, such as slot machine or roulette wheel mechanisms. In other embodiments, the objects may be polyhedra, the sides of which may be of various colors and/or marked with various indicia, such as letters, numbers, or symbols, such as the four suits in a standard deck of cards. In such embodiments, the polyhedra may be selected from regular polyhedra, such as a tetrahedron, a cube, an octahedron, a dodecahedron, and an icosahedron. Such regular polyhedra may be cast onto a gaming surface, or temporarily fluidized in a chamber, with equal odds for each side of a given polyhedron being selected in a play.

In another aspect of the games, a "bonus pool" may be defined for Players to attempt to win, in addition to the possibility of winning a wager on a single play of a game. The bonus pool may accumulate based on a portion of each Player's bet for all Players engaged in that game; and also for all sites where that game is being played. Accordingly, the bonus pool grows with each play in which the bonus is not won. The growing bonus payout may be displayed at each game site, so that prospective Players can see the large amount they could win. Such a display drives high excitement, and a stronger desire to play the game.

In another aspect of the games, all plays are independent of each other. Additionally, the objects of the games, their predefined categories, and a predefined hierarchy of the categories, and of the objects within categories may be chosen so that there is a resulting high probability of a winner on each play, wherein a Player wins at least some amount of funds on his wager. Such a configuration of the game also drives high excitement, and a stronger desire to play the game.

In certain embodiments, the games may be played at a physical location with physical objects. In other embodiments, the games may be played using one or more computers, wherein software is programmed to create a game virtually, simulating various objects, and making random selections of objects for matching, using random number generating algorithms. In embodiments where a game is played using more than one computer, such computers may be in communication via a network. In other embodiments, a game may be played with some Players participating at a physical location using physical objects, and other Players participating on one or more computers.

BRIEF DESCRIPTION OF THE DRAWINGS

The present disclosure will be provided with reference to the following drawings, in which like numerals refer to like elements, and in which.

Figure 1:
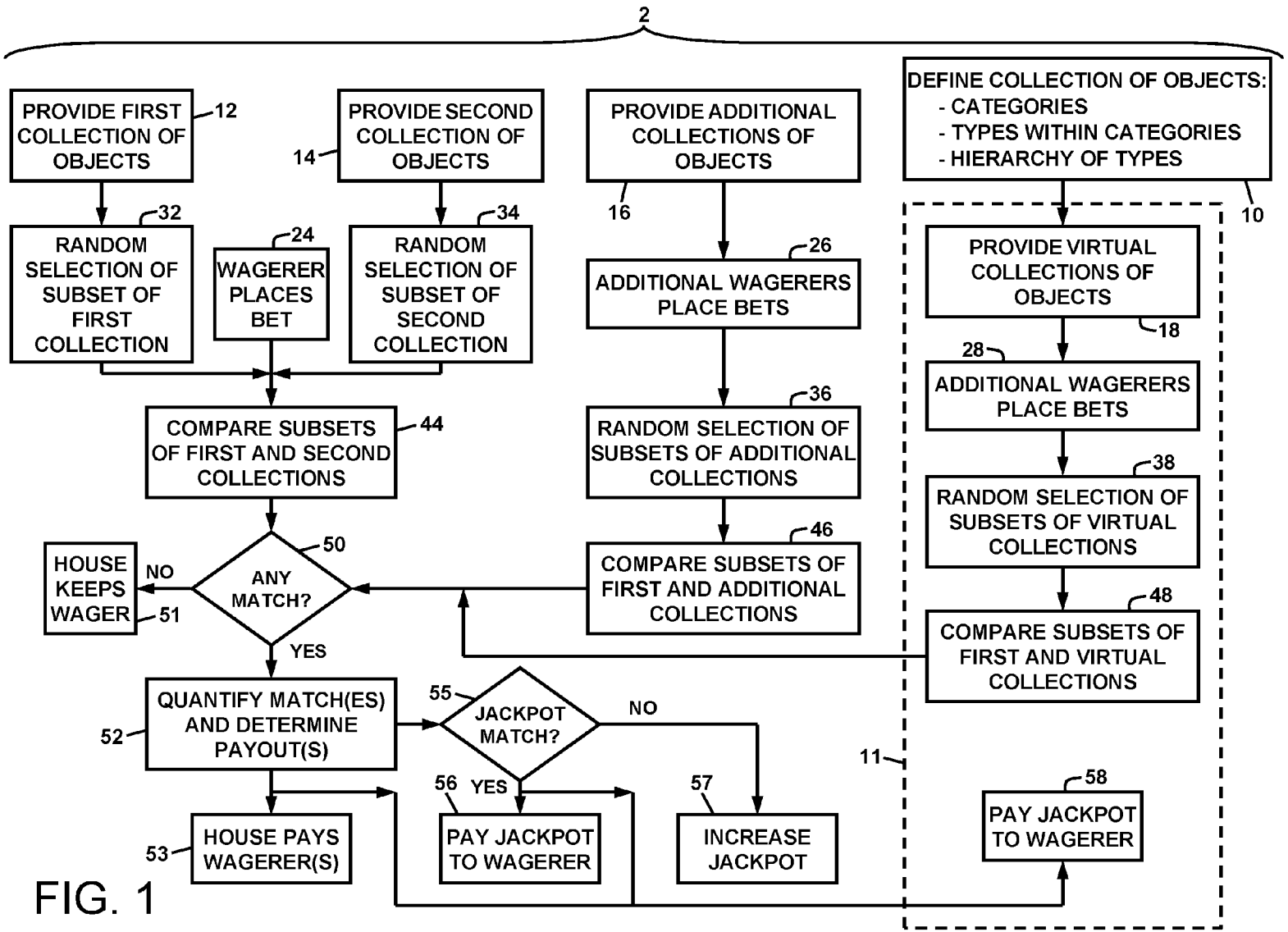
FIG. 1 is a flowchart depicting certain embodiments of wagering games of the present disclosure in a generalized manner.

The present invention will be described in connection with certain preferred embodiments. However, it is to be understood that there is no intent to limit the invention to the embodiments described. On the contrary, the intent is to cover all alternatives, modifications, and equivalents as may be included within the spirit and scope of the invention as defined by the appended claims.

DETAILED DESCRIPTION

For a general understanding of the present invention, reference is made to the drawings. In the drawings, like reference numerals have been used throughout to designate identical elements. The drawings are to be considered exemplary, and are for purposes of illustration only. In any drawings and related disclosure that depict methods of the present invention, the steps may vary from the order depicted, certain steps may be eliminated, and/or certain steps may be added, unless expressly stated otherwise.

As used herein, the term "plurality" is meant to indicate "at least two." Thus a "plurality of objects" is meant to indicate "at least two objects," and may indicate three, four, five, etc. or more objects.

As used herein, "virtual" is meant to indicate an object, a collection of objects, a space defined by boundaries, or an action or step of a method that is/are not physically existing (referring to an object), or occurring in a physical location (referring to an action), but instead is/are simulated by a computer for observation or other use by an observer.

As used herein, "random," used in characterizing a random selection of objects, is meant to indicate a lack of any structure or difference in the probability of any given occurrence in making the selection. In a random selection of objects, all occurrences of possible selections have equal probability of occurring. By way of example in the physical world, atmospheric noise is "random," as used herein. In applications of the present invention implemented on a computer, "random" selections of objects are made using a True Random Number Generator (TRNG) algorithm.

The games of chance disclosed herein may be played by parties at physical locations, such as casinos or clubs, or in homes in a retail board game version, possibly using a physical playing surface such as a table, or some other physical object. Alternatively the games may be played at a "virtual" casino, i.e., by a party observing a computer simulation of a casino, or simply observing and interacting with a computer that simulates and displays certain aspects of a game to the party, and receives input from the party such that it can be played by the party. Multiple parties may play the games at a physical location such as a casino, and in virtual embodiments, multiple parties may play the games using at least one computer. The multiple parties may receive communications from the computer and provide input to the computer from separate locations. The multiple parties may play the games using separate computers that are networked and in communication with each other. Alternatively, a particular game may be played in both the "real world" and virtually, i.e., some parties may be playing the game at a physical location, while others are playing the game through an interface with a computer, while receiving a communication of what is happening in the game at the physical location.

In one broadly characterized embodiment in which the game is a wagering game, the game is played at a physical location such as at a physical casino. The first party may be playing the game on behalf of the casino. In such an embodiment, the first party may be considered the "Dealer," and may be delegated with the authority to operate and control the game on behalf of the casino. The casino may operate as a business entity (legally incorporated or otherwise), and is commonly referred to colloquially as "the House." In such circumstances, the second party, the "Player," is a wagering party, with an interest adverse to the casino, i.e. the wagering party is playing the game to win money from the casino, and the casino is offering the game to the wagering party with the objective of keeping the money bet by the wagering party, or at least on average, to operate the game so as to take in more money bet by losing wagering parties than it pays out to winning wagering parties. (It is noted that the terms "Player" and "Wagerer" are used interchangeably in this disclosure.) The game may be played with multiple wagering parties, i.e., Players, pitted against the Dealer party. As will be explained subsequently, payouts to wagering parties are correlated with the probability of certain outcomes occurring when playing the game, and are set at levels so as to enable the casino to achieve its "on average" objective of earning money over a period of time.

In another broadly characterized embodiment in which the game is a wagering game, the game may be computer implemented and played in a virtual form. A first computer is provided, which contains an executable program that enables a wagering party to play a computer-implemented version of the game though a user interface that is in communication with the computer. The user interface may include a display and an input device such as a mouse, joystick, keyboard, motion/acceleration activated device, and/or voice-activated device; or the display may be a touch screen that receives input from the user, as well as displaying aspects of the game to the user. The user interface of the wagering party may be second computer in communication with the first computer, and may be embodied in e.g., a personal computer, a tablet computer, a smart phone, a smart watch, or another communication device.

The computer-implemented embodiment of the game may be played simultaneously by more than one wagering party. The computer controls the game, interacting with the wagering parties and functioning as the "Dealer" in the game, and playing on behalf of the "House," which may be the owner of the computer. In certain embodiments, the software that is provided to execute the game may include simulations of a human operating as the Dealer, and possibly also operating in a simulated location that appears as a casino to a wagering party. The display provided to the user may be a standard flat panel an image projected on a surface, or in the form of display screens fittable proximate to the eyes of the party, sometimes referred to as "virtual reality" glasses or a virtual reality headset.

In a broad sense, a game of chance as set forth in the present disclosure is a game in which at least two identical collections of objects are provided, the first collection being assigned to a first party playing the game, and the second collection being assigned to a second party playing the game. The collections of objects are characterized as belonging to a plurality of categories; preferably, each category contains the same number of objects. The objects within any individual category are all different from each other, i.e. of a different type. Accordingly, all of the objects in the collection of objects are unique, i.e., different from every other object in the collection, since each object has its category characteristic and its individual type characteristic in that category. The object types within the individual categories may be classified according to a hierarchy, such that the objects within an individual category have values that ascend from a lowest value to a highest value. Additionally, in certain embodiments, across the plurality of categories, the objects are the same, i.e. they may have the same types, and according to the same hierarchy if applicable.

The second collection of objects is preferably identical to the first collection of objects; but at the very least, the second collection of objects has at least all of the same objects as the first collection.

The game may be played in the "real world," i.e., the objects may be physical objects at a physical location such as a casino and handled by humans, or the objects may be virtual objects, simulated by a computer and presented to a party who is playing the game at a user interface in communication with the computer, as described above. Alternatively, the same game may be played in both the "real world" and virtually, i.e., some parties may be playing the game at a physical location, while others are playing the game through an interface with a computer, while receiving a communication of what is happening in the game at the physical location. In the following descriptions of embodiments of the game, unless expressly stated otherwise, it is to be understood that the descriptions apply to physically played versions of the game, virtual versions of the game played using a computer and software, and combinations of physical and virtual play. Thus for example, the recitation of "objects" is meant to encompass both physical objects and virtual objects as applied to physical and virtual versions of the game.

In a generalized wagering version of the game played by a Dealer party ("Dealer") operating on behalf of the "House" and a wagering party ("Player" or "Wagerer"), the first collection of objects is assigned to the Dealer, and the second collection of objects is assigned to the Player. The Player places a bet of funds of predetermined value against the House. The funds may be physical money, i.e., coins or currency, or some physical object equated with money such as a casino chip, or the funds may be transacted via a credit or debit card. The funds may be proffered in digital form, such as bitcoin.

In the event of an outcome of the game in favor of the House, the Player loses the bet, and the House keeps the funds. In certain embodiments, a predetermined portion of all Player losses are incrementally added to a bonus "pool" from each physical or virtual location and Player playing the game at that time. The bonus pool may increment at all physical and virtual locations, and may be shown at each location before the next deal of the game.

In the event of an outcome of the game in favor of the Player (a "winning" outcome), the House returns the bet of funds to the Player, and further pays out additional funds to the Player. The amount of additional funds depends upon the probability of the occurrence of a particular outcome of the game, commonly refer to as "odds". Because the content of the collections of objects is known in advance, a range of possible outcomes is also known, with the probability of the various possible outcomes also known. Thus the amount of additional funds to be paid out to the Player for each particular winning outcome is also predetermined. There may be a single maximum payout for the winning outcome that has the lowest probability of occurring. In certain embodiments, each time the game is played at any physical or virtual location, the House will increase the payout for the next occurrence of that outcome, as described previously. In other words, the maximum payout is a bonus pool of funds that continually increases until a Player achieves the lowest probability winning outcome, i.e. "hits the jackpot." In certain embodiments, even when a Player has a winning hand (i.e., winning outcome), if it is not the jackpot outcome, the House may the wagered funds and/or a portion of the Player's winnings to the bonus pool.

In the most generalized disclosure of the game, the first collection of objects is mixed or shuffled so as to be in a random order. A subset of at least two objects is to be selected from the first collection of objects. Since the first collection of objects is in a first random order, the first objects in the first random order of objects, the number of which is equal to the desired number of objects in the subset of objects, may simply be selected.

In an alternative embodiment, the first collection of objects may be in a specific order, but instead, the desired number of objects in the first subset of objects may be selected from random locations in the first collection of objects. In either embodiment, what is accomplished is that the first subset of objects is randomly selected from the first collection of objects.

The first collection of objects is characterized as having a plurality of categories, and across the plurality of categories, the objects have the same values, and according to the same hierarchy. Accordingly, the subset of objects randomly selected from the first collection of objects has certain characteristics. The subset of objects may be all of the same category. The subset of objects may be all of the same type, but across different categories. The subset of objects may be in a monotonically ascending order of values but of different categories, or the same category. The foregoing are just some examples of characteristics of the subset of objects; other characteristics are possible. In certain wagering versions of the game, the first collection of objects, and thus the subset of objects randomly selected from the first collection of objects are assigned to a Dealer, and are the House's objects. In other embodiments, the first collection of objects, and thus the subset of objects randomly selected from the first collection of objects are assigned to the Player, and are the Player's objects.

Continuing with the description of play of the wagering game in its most generalized form, a second collection of objects is provided, which at least contains identical objects to the first collection of objects. A predefined subset of at least two objects is randomly selected from the second collection of objects, the number of which subset is the same as the number of objects in the previously described subset of objects randomly selected from the first collection of objects. As previously described for selecting the subset of objects randomly selected from the first collection of objects, the predefined subset of randomly selected objects from the second collection of objects may be selected by shuffling or mixing the second collection of objects to cause them to be in a random order, and then selecting the subset as the first of the objects in the random order. Alternatively, the second collection of objects may be in a specific order, with the desired number of objects to obtain the subset of objects being selected from random locations in the second collection of objects. In a wagering version of the game, the second collection of objects, and thus the subset of objects randomly selected from the second collection of objects are assigned to a Player, and are the Player's objects.

Dealer—Player Match Game Embodiments

In certain embodiments of the games, prior to the selection of the Dealer's subset of objects randomly selected from the first collection of objects and the selection of the Player's subset of objects randomly selected from the second collection of objects, the Player has placed a bet of funds against the House that a favorable outcome will occur in the random selection of the subset of objects from the second collection of objects (the Player's objects) as compared to the random selection of the subset of objects from the first collection of objects (the House's objects).

The Player's randomly selected objects from the second collection of objects are then compared to the House's randomly selected objects from the first collection of objects. In one embodiment of the game, the comparison is simply to determine whether or not there is any matching of the Player's randomly selected objects with the House's randomly selected objects. One possible outcome is that there is no match between the objects, or no sufficient match to exceed a threshold probability. In this circumstance, the Player loses the bet, and the House retains the wagered funds.

Another possible outcome is that there is at least a partial match of the Player's randomly selected objects with the House's randomly selected objects. There is a range of possible matches, such as a match of the same type of objects, and/or a match of the category of objects. In this circumstance, the House remits the wagered funds back to the Player, and pays an additional amount of funds to the Player. The amount paid depends upon the probability of the particular partial match occurring.

Another possible outcome is that there is an exact match of the Player's randomly selected objects with the House's randomly selected objects. In this circumstance, the House remits the wagered funds back to the Player, and pays an additional amount of funds to the Player, which is based upon the probability of an exact match occurring, and is a considerably higher payment that is proffered for a partial match.

Within the possible "exact match" outcomes, there is an additional range of possible outcomes that differ in their probability of occurring. Accordingly, the payout for these possible outcomes will vary with their respective probabilities, which are calculated in advance to define the respective payouts. One possible outcome is that the plurality of randomly selected objects from the first and second collections of objects that exactly match each other all fall within the same category. In an embodiment in which the types of objects within a category are assigned values according to a hierarchy, another possible outcome is that the plurality of randomly selected objects that exactly match each other also monotonically increase in value. Another possible outcome is that both of the above are true, i.e., the randomly selected objects are all of the same category, and also increase monotonically in value. Within that possible outcome, the randomly selected objects that are of the same category and monotonically increasing in value are also of the maximum values in the category.

Lastly, the various categories themselves may be assigned value according to a hierarchy. One category will have the highest value. Thus there is a single highest value outcome, in which the randomly selected objects that are of the same category and monotonically increasing in value and also of the maximum values in the category also fall in the highest value category. This outcome has the lowest probability of occurrence, and thus has the highest payout to the Player.

It will be apparent that this lowest probability/highest payout outcome will be a rare occurrence, and may have a payout much higher than other payouts for other winning occurrences. It will be further apparent that the game may be played over and over again, perhaps millions of times, without this lowest probability/highest payout outcome occurring. In certain embodiments, to make the game more attractive to prospective Players, each time the game is played, and the lowest probability/highest payout outcome does not occur, the House incrementally increases the payout for the next occurrence of that outcome. Thus the maximum payout includes a pool of funds that continually increases until a Player achieves the lowest probability winning outcome, i.e. "hits the jackpot."

To further illustrate the above generalized disclosure of the game, FIG. 1 is a flowchart that depicts the creation and playing of the game as a wagering game. The game 2 is created by first defining 10 the collection of objects to be used in playing the game. Categories of objects are defined, and the types of objects within the categories are also defined. A hierarchy of value of the types of objects may also be defined. The categories may also be classified according to a hierarchy of values.

Collections of the objects are also provided. In an embodiment in which only two parties play the game, first and second collections 12 and 14 of objects are provided. If additional parties are playing the game, additional collections 16 of objects are provided. The collections of objects may be of physical objects, with the parties playing the game at a physical location and using other elements such as a predefined playing surface. Alternatively, the collections of objects may be of virtual objects, with the parties playing the game using user interface devices in communication with a computer, which contains a software program to execute the game. Alternatively, some of the collections of objects may be of physical objects, with the parties playing the game at a physical location, while other parties are playing the game using user interface devices in communication with a computer 11. In this case, the computer 11 provides virtual collections 18 of objects to the parties playing via the computer 11.

In the game 2, the first collection 12 of objects is considered as being assigned to the "House," and the second collection 14 and additional collections 16 and 18 are assigned to the second and additional parties. The Player (second party) places a bet of funds 24 against the House (first party) on a favorable outcome in the subsequent random selection of objects from his (the second) collection 14 of objects. Any additional wagering parties playing physically place their bets 26, and any additional wagering parties playing virtually place their bets 28.

In the game 2 played in a physical location, the game 2 may be controlled by a Dealer (not shown), who makes a random selection 32 of a subset of objects from the first collection 22. A random selection 34 of a subset of objects from the second collection is then made for the second party playing the game. If additional parties are playing the game, additional subsets 36 are selected for the additional parties. If a Dealer is controlling the game, the Dealer may make the selections, or the individual parties may make their selections. If a computer is operating the game, the computer makes the selections, following an input prompt communicated to the wagering Player parties. If a Dealer is controlling the game at a physical location, and additional parties are playing via communication with a computer 11, the computer 11 makes additional random selections of subsets of virtual objects 38 from the respective virtual collections 18, following an input prompt communicated to the parties playing virtually.

The subsets 32 and 34 of the first and second collections are then compared 44 to determine if the outcome 50 is that there is any match between them. If there is no match, the second party playing the game loses, and the House keeps 51 the funds wagered. If there is at least some match, the degree of match is quantified 52 as predefined by calculation of the probability of the particular match. The House remits the second party's wager 24 back to him/her, and further pays 53 the second party an additional sum of funds for a winning outcome. The additional sum of winnings is correlated with the probability for the particular matching outcome, with winnings payments varying inversely with probability.

As described previously, there may be a single maximum payout for the winning outcome that has the lowest probability of occurring. In such an embodiment, an additional check 55 is performed to determine if the lowest probability "jackpot match" outcome has occurred. If such jackpot match 55 has occurred, the House further pays 56 the accumulated funds in the jackpot to the second party. If such jackpot match 55 has not occurred, the House adds 57 an incremental amount of funds to the jackpot. In that manner, as the jackpot continually grows over time until the lowest probability "jackpot match" outcome occurs, the game 2 becomes more attractive for parties to engage in play.

If additional parties are playing the game 2, the subsets 32 and 36 of the first and additional collections are compared 46 to determine if the outcome 50 is that there are any matches between the first subset 32 and any of the additional subsets 36. For those parties whose subsets have no match, they lose, and the House keeps 51 their funds wagered. For the playing parties whose subsets have at least some match, the respective degrees of match are quantified 52 as described previously. The House remits these winning parties' wagers 26 back to them, and further pays 53 these parties additional sums of funds for their respective winning outcomes. The additional check 55 is performed to determine if the lowest probability "jackpot match" outcome has occurred for any of the additional parties. If such jackpot match 55 has occurred, the House further pays 56 the accumulated funds in the jackpot to that additional winning party. If such jackpot match 55 has not occurred, the House adds 57 incremental amounts of funds to the jackpot in proportion to the number of additional parties that played but did not win the jackpot.

As stated previously, the entire above scenario may be played out in a physical location with physical objects and may be controlled by a Dealer, or it may be implemented on a computer. In a further embodiment, if additional parties are playing the game virtually, their subsets 38 of virtual collections of objects are compared 48 with the subset 32 of the first collection. For those additional parties having no matches, their funds are kept 51 by the House. For those parties having at least some match, their wagers are returned, and further respective payouts 53 are made to them, which correlate to the respective probabilities of their matches. Additionally, any virtual Player who has the lowest probability "jackpot match" outcome receives the payment 58 of the jackpot, and in the event that no additional Player wins the jackpot, the House adds 57 incremental amounts of funds to the jackpot in proportion to the number of additional parties that played but did not win the jackpot. With this portion of the game and the interaction with the parties playing the game virtually being implemented on a computer, the transfers of funds from the Players to the House and vice versa may also be implemented via the computer, i.e. as electronic funds transactions.

In additional embodiments, versions of the game are provided in which the funds wagered have a non-monetary value, such as for recreational home and family use. The funds may be "play money" (like MONOPOLY® money), or any other representation of money of something else of value. Alternatively, the "non-monetary" funds may simply be numerical values, with scoring in the game based upon the probability of the occurrences of the various matches that are possible in the game. Such embodiments may be packaged physical versions of the game sold to consumers as physical retail products, or virtual versions playable on personal computers, tablets, smartphones, and other portable computing devices. Additionally such versions of the games may be played by multiple parties on computing devices that are in communication with each other via a network. All of the exemplary embodiments of the game described herein, as well as other embodiments not described but falling under the broad concept of the game may be provided as non-wagering embodiments. In such embodiments, rather than wagered funds won or lost as the metric of success in playing the game, other non-monetary scoring systems may be devised.

Exemplary Embodiments—Card Version of Dealer-Player Match Game

In one aspect of the instant game of chance, the collections of objects may be cards. The cards have a category characteristic, and within each category, a type characteristic. The type characteristics are the same within each category. The type characteristics may be assigned a hierarchy of values.

Although an endless variety of collections of cards may be used, in certain embodiments, a standard deck of playing cards may be used, i.e., a deck of cards comprised of four suits, Spades (S), Diamonds (D), Clubs (C), and Hearts (H), each suit having cards 2-10, Jack (J), Queen (Q), King (K), and Ace (A). The deck of playing cards may further include additional cards, such as Jokers, which may function as "wild" cards. Exemplary embodiments of card versions of the game will now be described as being played with a standard deck of cards. However, it is to be understood that the card versions of the instant game may be played with other collections of cards.

Figure 2:
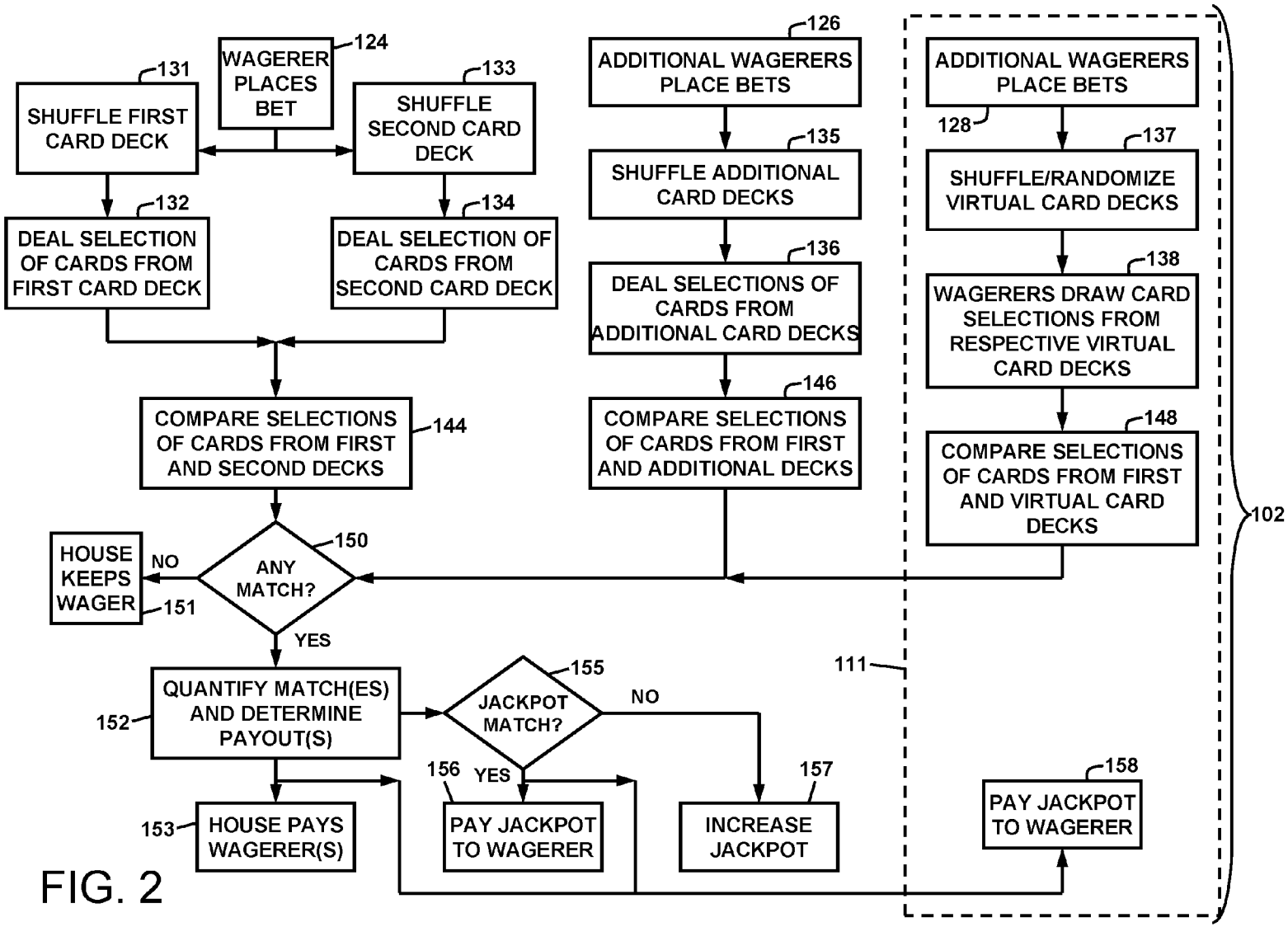
FIG. 2 is flowchart depicting embodiments of wagering games of FIG. 1 that are played using playing cards.

Referring to FIG. 2, which depicts embodiments of the instant wagering games that are played using playing cards, step 10 (as described with reference to FIG. 1) is not shown. The collection of objects is embodied in a deck of cards, with the categories being the four suits, the types of cards being cards 2-10, J, Q, K, and A, with values per the commonly recognized hierarchy in the above recited order.

In the game 102, a first deck of cards is considered as being assigned to the "House," and a second card deck and additional card decks are assigned to the second and additional parties (card decks not shown). The Player places a bet of funds 124 against the House on a favorable outcome of at least some match of randomly selected cards from his deck matching randomly selected cards from the House deck.

Any additional wagering parties playing physically place their bets 126, and any additional wagering parties playing virtually place their bets 128.

In the game 102 played in a physical location, the game 102 may be controlled by a Dealer (not shown), who makes a random selection of a subset of cards from the first deck. To make the random selection, the first deck of cards may be shuffled 131, and then the desired number of cards is dealt 132 off the top of the deck. Other random card selection techniques may be used.

A random selection 134 of a subset of cards from the second deck is then made for the second party playing the game. If additional parties are playing the game, additional subsets 136 are selected from the respective additional card decks for the additional parties. If a Dealer is controlling the game, the Dealer may make the selections; or the individual parties may make their selections. If a computer is operating the game, the computer makes the selections using a random number generating algorithm, following an input prompt communicated to the wagering Player parties.

If a Dealer is controlling the game at a physical location, and additional parties are playing via communication with a computer 111, the computer 111 makes additional random selections of subsets of virtual cards 38 from the respective virtual card decks using a random number generating algorithm, following an input prompt communicated to the parties playing virtually. In one embodiment of first Players at a physical location and second Players playing via communication with a computer 111, a video camera is provided with image processing software, wherein an image of the subset of cards from the first (Dealer's) deck is captured and processed. Via an optical character recognition algorithm, the subset of cards dealt from the first deck is recognized and uploaded into the gaming program in the computer 111. The computer 111 then completes play of the game with those parties playing virtually as described immediately below. In that manner, those parties playing virtually can enjoy the excitement of playing the game as if they were at the physical location.

The subsets 132 and 134 of the first and second card decks are then compared 144 to determine if the outcome 150 is that there is any match between them. If there is no match, the second party playing the game loses, and the House keeps 151 the funds wagered. If there is at least some match, the degree of match is quantified 152 as predefined by calculation of the probability of the particular match. The House remits the second party's wager 124 back to him/her, and further pays 153 the second party an additional sum of funds for a winning outcome. The additional sum of winnings is correlated with the probability for the particular matching outcome, with winnings payments varying inversely with probability. The probabilities and associated payouts will further depend upon the particular version of the game being played. Exemplary embodiments of two card and three card versions of the game are described subsequently herein, including probabilities of certain matches occurring when playing them.

As described previously, there may be a single maximum payout for the winning match that has the lowest probability of occurring. In such an embodiment, an additional check 155 is performed to determine if the lowest probability "jackpot match" outcome has occurred. If such jackpot match 155 has occurred, the House further pays 156 the accumulated funds in the jackpot to the second party. If such jackpot match 155 has not occurred, the House adds 157 an incremental amount of funds to the jackpot. In that manner, as described previously, the jackpot continually grows over time until the lowest probability "jackpot match" outcome occurs, and the game 102 becomes more attractive for parties to play.

If additional parties are playing the game 102, the subsets 132 and 136 of the first and additional card decks are compared 146 to determine if the outcome 150 is that there are any matches between the first subset 132 and any of the additional subsets 136. For those parties whose card subsets have no match, they lose, and the House keeps 151 their funds wagered. For the playing parties whose subsets have at least some match, the respective degrees of match are quantified 152 as described previously, and as will be illustrated in examples described subsequently herein. The House remits these winning parties' wagers 126 back to them, and further pays 153 these parties additional sums of funds for their respective winning outcomes. The additional check 155 is performed to determine if the lowest probability "jackpot match" outcome has occurred for any of the additional parties. If such jackpot match 155 has occurred, the House further pays 156 the accumulated funds in the jackpot to that winning additional party. If such jackpot match 155 has not occurred, the House adds 157 incremental amounts of funds to the jackpot in proportion to the number of additional parties that played but did not win the jackpot.

As stated previously, the entire above scenario may be played out in a physical location with physical decks of cards and may be controlled by a Dealer, or it may be implemented on a computer. In a further embodiment, if additional parties are playing the game virtually, their respective subsets 138 of their decks of cards are compared 148 with the subset 132 of the first deck. For those additional parties having no matches, their funds are kept 151 by the House. For those parties having at least some match, their wagers are returned, and further respective payouts 153 are made to them, which correlate to the respective probabilities of their matches. Additionally, any virtual Player who has the lowest probability "jackpot match" outcome receives the payment 158 of the jackpot, and in the event that no additional Player wins the jackpot, the House adds 157 incremental amounts of funds to the jackpot in proportion to the number of additional parties that played but did not win the jackpot. With this portion of the game and the interaction with the parties playing the game virtually being implemented on a computer, the transfers of funds from the Players to the House and vice versa may also be implemented via the computer, i.e. as electronic funds transactions.

The following are descriptions of three card and two card versions of the game, in which a standard deck of playing cards is used in play. It is to be understood that these are merely examples and are provided as being illustrative and not limiting. Furthermore, for simplicity of explanation, the examples will be described as being played only by a Dealer party and a single wagering party, and at a physical location. It is to be understood that the exemplary games may be played by multiple wagering parties against the House, and also played either at the physical location, or virtually using a computer as described previously.

Figure 3:
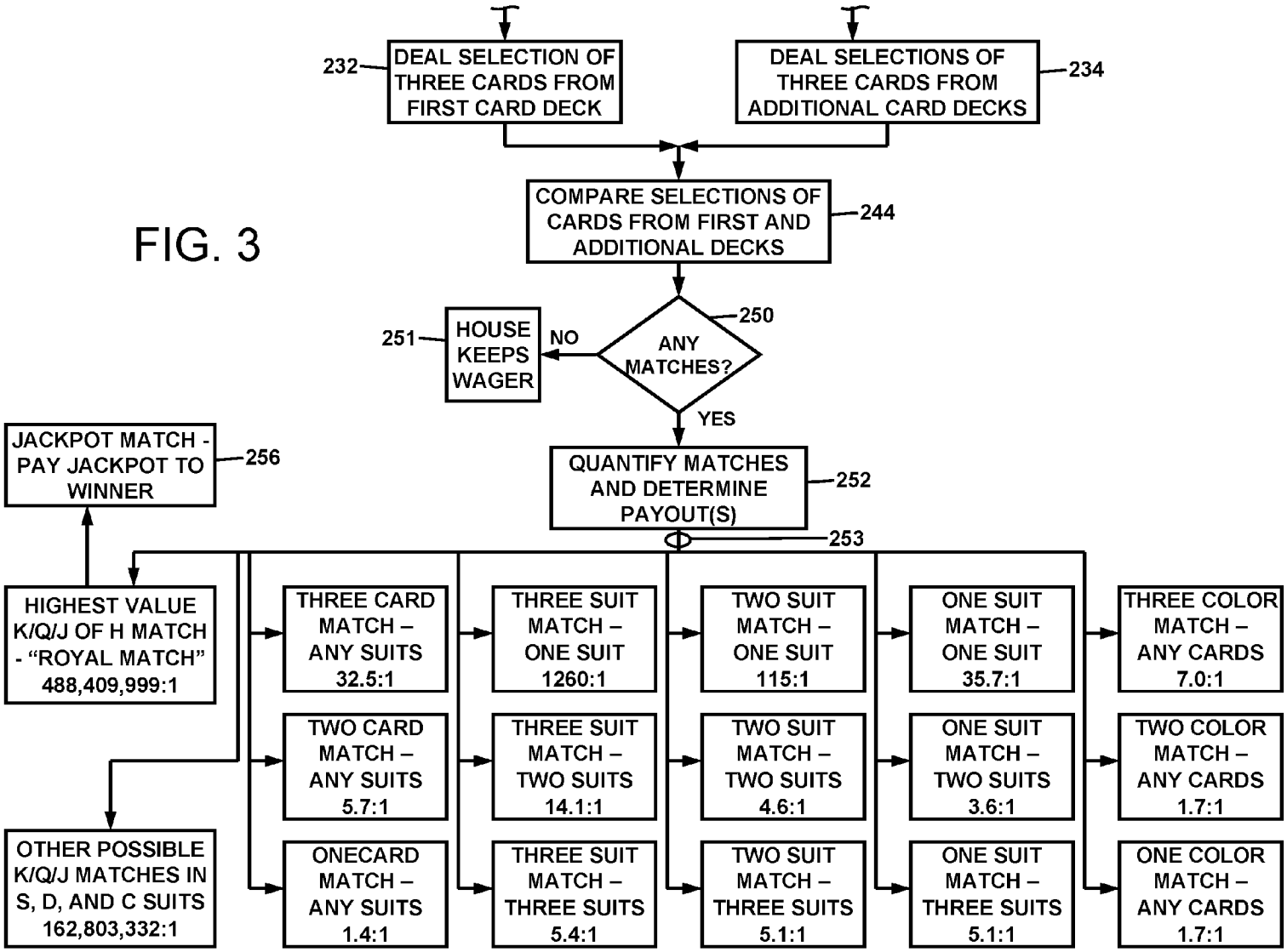
FIG. 3 is a flowchart of an embodiment of a wagering game that is played with playing cards as a "three card match" game.

Example—Three Card Version of Dealer-Player Match Game with Standard Playing Cards Referring again to FIG. 2, standard decks of playing cards are provided, the Dealer's deck and the Players' decks. The Players place bets of funds against the House. All decks are shuffled so that cards dealt from the respective tops of the decks are randomly selected. Referring also to FIG. 3, the Dealer deals 232 three cards from his deck. The cards may be dealt face down. The Dealer deals 234 three cards from the Players' decks. (Or alternatively, the Players may deal their three cards from their deck if permitted by House rules.) The Players' cards may also be dealt face down. In embodiments of the game implemented on a computer, the dealing of the Dealer's and the Players' cards are simulated, with the random selections of each set of the three cards dealt being done with a random number generating algorithm embodied in a software program that is executed by the computer.

ability. TABLE 1 is a listing of the range of possible matches, and the respective probabilities of the matches occurring. (Probability is referenced to unity, i.e. a 1.0 probability is a 100% chance of occurrence.) The listing is not to be construed as exhaustive, i.e., other matches may be possible. Additionally, the probabilities of certain combinations of occurrences listed in TABLE 1 may be divided into individual occurrences having respective individual probabilities.

TABLE 1

Probabilities of occurrence of various matches in three card version of game.

| | Match Examples | | Probability P | "Odds" |
|---|---|---|---|---|
| Match Description | House Cards | Player Cards | of Occurrence | (1/P − 1) |
| Lowest probability/highest value match - "Royal Match" | KH, QH, JH | KH, QH, JH | $2.0475 \times 10^{-9}$ | 488,409,999:1 |
| Three remaining possible K/Q/J matches in S, D, and C suits | KS, QS, JS | KS, QS, JS | $6.1424 \times 10^{-9}$ | 162,803,332:1 |
| Three card match - any suits | 3C, 5H, 6S | 3H, 5D, 6S | 0.029864253 | 32.5:1 |
| Two card match - any suits | 3C, 5H, 6S | 3H, 5D, 2S | 0.149321267 | 5.7:1 |
| One card match - any suits | 3C, 5H, 6S | 3H, 10D, 2S | 0.423529412 | 1.4:1 |
| Three suit match - one suit | 10S, 8S, 3S | 5S, 2S, QS | 0.000793269 | 1259.6:1 |
| Three suit match - two suits | 10S, 4D, 8D | 3S, 6D, 5D | 0.066176471 | 14.1:1 |
| Three suit match - three suits | 10S, 8C, 4D | 8S, 7C, 2D | 0.155073529 | 5.4:1 |
| Two suit match - one suit | 10S, 8S, 3S | 5S, 2S, QH | 0.008602941 | 115.2:1 |
| Two suit match - two suits | 10S, 4D, 8D | 3S, 6D, 5H | 0.179815574 | 4.6:1 |
| Two suit match - three suits | 10S, 8C, 4D | 8S, 7H, 2D | 0.163455882 | 5.1:1 |
| One suit match - one suit | 10S, 8S, 3S | 8S, 2C, QH | 0.027242647 | 35.7:1 |
| One suit match - two suits | 10S, 4D, 8D | 3S, 6C, 5H | 0.215073529 | 3.6:1 |
| One suit match - three suits | 10S, 8C, 4D | 8S, 7H, 2H | 0.163455882 | 5.1:1 |
| 3 color match - any cards | 10S, 4C, QS | 7S, 6C, JC | 0.125000000 | 7.0:1 |
| 2 color match - any cards | 10S, 2C, 4D | 10H, 2C, 3S | 0.375000000 | 1.7:1 |

The Dealer's three cards and the sets of the Players' three cards are then compared 244 to determine if there is any match. In embodiments in which the cards are dealt face down, additional wagering opportunities may be provided to the Players, as described previously. The additional wagering opportunities may proceed where the Dealer and Players each show one card at a time, with the Players having an opportunity to increase their respective wagers after each card turn; or the additional wagering opportunities may proceed where the Dealer shows all three of his cards, and the Players shows one card at a time, with the Players having an opportunity to increase their wagers after each card turn.

In another embodiment, the Dealer turns over all three of his cards, and then the Players turns over all three of their cards. The Players' trios of cards are compared 144 to the Dealer's trio of cards to determine if there is any match 250. As described previously, for any given Player, if there is no match, i.e. none of that Player's cards share common suit with any of the Dealer's cards and none of that Player's cards share a common value with any of the three Dealer's cards, then that Player loses the bet and the House retains 251 that Player's funds. (Additionally, the House rules may define a minimum threshold match that must be attained in order for the House to pay winnings to the Player; otherwise the Player loses the bet and the House retains 251 the wagered funds.)

For any given Player, if there is at least some threshold match between the trios of cards, the House may return that Player's funds and may make a further payout 253. As described previously, the degree of match, and payout of winnings to the Player, if any, are quantified by correlating the payout to the probability of the particular match occurring with winnings payments varying inversely with prob- In TABLE 1, the "odds" (which is defined in TABLE 1 as the reciprocal of probability minus one) of the various matches occurring are also provided. (It is noted that most of the odds listed have been rounded off to two or three significant figures.) "Odds" are more typically used as a reference number for Players in making their wagers and in considering their potential winnings from a wager. For example, the lowest probability match (the "Royal Match") of the King, Queen, and Jack of Hearts has a probability of $2.0475 \times 10^{-9}$, and thus the odds of such a match occurring are 488,409,999 to one, or one in about five hundred million. Accordingly, the maximum payout for such a match (excluding any additional accumulated "jackpot" payout as described herein) would be $488,409,999 for one dollar wagered. However, the odds presented to prospective Players, and thus the payout for any winners would be set at a lesser value in order to provide a profit margin to the House. In like manner, other quoted odds and payouts would be discounted below the theoretical odds in order to ensure a profit by the House.

In this three-card version of the game, the set of outcomes that are defined as winning outcomes is quite extensive—there are up to seventeen winning outcomes in toto. The probability of there being no match in a single play of the game, as shown in TABLE 2, is low. Therefore, for any single play, the overall probability of there being at least some winning outcome, even if the payout is relatively small, is high. This high probability of a win on any given play makes the game attractive to prospective Players.

In certain embodiments, the rules of the game may define a single trio of cards that are assigned to have the maximum value and therefore the lowest probability of occurring in a match between the three cards from the Dealer's deck and the three cards from a Player's deck, i.e. the "jackpot" match. (For example, the game might be branded as "Royal Match," and the jackpot match could be predetermined as the matching trio of cards being the King, Queen, and Jack of Hearts.) In a further embodiment of the game, as described previously, an additional check 155 may be performed to determine if the "jackpot match" outcome has occurred. Referring also to FIG. 2, if such jackpot match 155 has occurred, the House further pays 256 the accumulated funds in the jackpot to the wagering party. If such jackpot match 155 has not occurred, the House adds 157 an incremental amount of funds to the jackpot. Thus the jackpot continually grows over time until the lowest odds "jackpot match" outcome occurs, and with such growth, the game becomes more attractive for parties to play.

In summary, the "three card" version of the game including the operation of an associated bonus pool as described above has the attributes of being easy to learn, and having a fast rate of play, a high frequency of wins and Players, and a very high potential payout of funds for a bonus pool win. Such attributes are particularly attractive to prospective payers at a casino and on online computer-implemented versions of the game, and also to gaming establishments that may offer the game because of the high profit margins in setting payouts, and the high volume of Players engaged in the game.

Example—Two Card Version of Dealer-Player Match Game with Standard Playing Cards Two standard decks of playing cards are provided, the Dealer's deck and the Player's deck. The Player places a bet of funds against the House. Both decks are shuffled so that cards dealt from the respective tops of the decks are randomly selected. The Dealer deals two cards from his deck. The cards may be dealt face down. The Dealer deals two cards from the Player's deck. (Or alternatively, the Player may deal his two cards from his deck if permitted by House rules.) The Player's cards may also be dealt face down.

Referring again to FIG. 2, the Dealer's two cards and Player's two cards are then compared 144 to determine if there is any match. In embodiments in which the cards are dealt face down, additional wagering opportunities may be provided to the Player. In one embodiment, the Dealer turns over one of his cards, and then the Player turns over one of his cards. If the Player likes what he sees, i.e., there is already at least some match, the House may offer the Player an opportunity to increase his wager, but with a requirement that a further match is attained between the second cards. Alternatively, the Player can "hold," i.e. make no change to his wager. In another embodiment, the Dealer turns over both of his cards, and then the Player turns over one of his cards. Again, if the Player likes what he sees, i.e., there is already at least some match, the House may offer the Player an opportunity to increase his wager, but with a requirement that a further match is attained between the second cards.

In another embodiment, the Dealer turns over both of his cards, and then the Player turns over both of his cards. The pairs of cards are compared 144 to determine if there is any match 150. As described previously, if there is no match, i.e. neither of the Player's two cards share common suit with either of the Dealer's two cards and neither of the Player's two cards share a common value with either of the Dealer's two cards, then the Player loses the bet and the House retains 151 the wagered funds. If there is at least some match between the pairs of cards, the House may return the Player's funds and may make a further payout 153. The degree of match, and payout of winnings to the Player, if any, are quantified by correlating the payout to the probability of the particular match occurring with winnings payments varying inversely with probability.

The rules of the game may define a single pair of cards that are assigned to have the maximum pair value and therefore the lowest probability of occurring in a match between the two cards from the Dealer's deck and the two cards from the Player's deck, i.e. the "jackpot" match. In a further embodiment of the game, as described previously, an additional check 155 may be performed to determine if the "jackpot match" outcome has occurred. If such jackpot match 155 has occurred, the House further pays 156 the accumulated funds in the jackpot to the wagering party. If such jackpot match 155 has not occurred, the House adds 157 an incremental amount of funds to the jackpot. Thus the jackpot continually grows over time until the lowest probability "jackpot match" outcome occurs, and with such growth, the game becomes more attractive for parties to play.

Exemplary Embodiments—Rotating Selector Versions of Dealer-Player Match Game

In one aspect of the instant game of chance, the random selection of objects may be performed using rotatable wheels or rotatable discs. In an embodiment using rotatable wheels, such wheels may be similar to the spinning wheels in a "slot machine." Referring to FIG. 1, as applied to this embodiment of the game 2, the collection of objects is defined 10. In the embodiment using rotatable wheels, each wheel may have indicia on its perimeter, including numbers, letters, and/or symbols, that define the collection of objects. The objects to be selected may simply be various indicia of objects distributed over the perimeter of the wheels. Such objects may be numbers, letters, or symbols. Such objects may be symbols of the various cards in a standard deck of cards.

Each wheel may define a category of objects. The objects are of various types; the types of objects may be classified according to a hierarchy of low values to high values. In playing the game in a physical location, a Dealer, who is operating the game on behalf of the casino (the "House") is provide with a first collection of objects 12, which is comprised of a set of rotatable wheels with the various objects represented by the indicia on the perimeters thereof. In like manner, additional collections of objects, i.e. respective sets of rotatable wheels that are identical to the Dealer's set of wheels are provided 14/16 to Players of the game (the Players).

Referring again to FIG. 1, the Players place their bets 24/26. The Dealer spins his wheels, which will result in a random selection 32 of a subset of the first collection of objects. For each spinning wheel, the respective random object will be the object that is viewable through a small window, or the object that aligns with a marker, when the wheel stops spinning. In like manner, the Players spin their wheels, which will result in random selections 34/36 of a subset of their respective collections of objects. In certain embodiments, the respective wheels may be spun by direct contact of the Dealer and the Players, i.e., by grabbing each wheel and spinning it. In other embodiments, each set of wheels assigned to the Dealer and Players may be spun by pulling a respective lever that is connected to a mechanism that causes that set of wheels to spin, much as a mechanical slot machine operates.

The Dealer's subset of objects is compared 44 with the various Players' subsets of objects to determine 50 if there are any matches. For any given Player, if there are no matches, the House keeps 51 that Player's funds. If there is any match, the degree of the match is quantified, and a payout to the Player is determined 52. The House returns the wagered funds and further pays 53 additional funds to the Player, the amount of which is dependent upon the "quality" of the match, i.e. the payout varies inversely with the probability of the occurrence of the particular match.

As described previously, there may be a single maximum payout for the winning outcome that has the lowest probability of occurring. In such an embodiment, an additional check 55 is performed to determine if the lowest probability "jackpot match" outcome has occurred for any given Player. If such jackpot match 55 has occurred, the House further pays 56 the accumulated funds in the jackpot to that Player. If such jackpot match 55 has not occurred, the House adds 57 an incremental amount of funds to the jackpot. As the jackpot continually grows over time, the game 2 becomes more attractive for parties to engage in play.

It is noted that in performing step 10, defining the collection of objects, their categories, types within categories, and any hierarchy of types, the collection of objects may be defined so as to result in a relatively high overall probability of there being at least some match occurring, and therefore at least some payout to a Player, even if relatively small. A high probability of a win on any given play makes the game attractive to prospective Players.

In certain embodiments, the collections of objects defined on the perimeters of the wheel may be playing cards. In one embodiment, there may be four wheels containing playing card objects, thereby attracting prospective Players by simulating the popular "four-card" mechanical slot machine, with which they are familiar.

It is further noted that in determining the payouts for the various matches, the probabilities of such matches are calculated, as well as the "odds" of each match. In operating the game, the House would likely pay out at a rate that is lower than the respective odds for each occurrence, in order to provide a satisfactory profit margin of the House.

In an alternative embodiment of the rotating selector version of the game, the rotating selectors may be configured as rotatable discs. Each rotatable disc may have indicia on its perimeter, including numbers, letters, and/or symbols, that define the collection of objects. In playing the game in a physical location, the Dealer and each Player are provided with sets of rotatable discs, which may be similar to "roulette wheels," that include a marker near the wheel perimeter that defines a selection when the wheel stops rotating. Play of the game proceeds as described above for play with rotatable wheels.

In certain embodiments, the game may be played using one or more computers, wherein software is programmed to create the game virtually, simulating the rotatable wheels or discs, and making random selections of objects for matching, using random number generating algorithms. In embodiments where the game is played using more than one computer, such computers may be in communication via a network. In other embodiments, the game may be played with some Players participating at a physical location using physical rotatable wheels or discs, and other Players participating on one or more computers.

Exemplary Embodiments—Chambered Object Selector Versions of Dealer-Player Match Game In one aspect of the instant game of chance, the random selection of objects may be performed wherein the objects are contained in a chamber. In certain embodiments, the objects may be balls, and the chamber may be supplied with a fluidizing medium, such as a liquid, or a gas such as air. The fluidizing medium is delivered into the chamber, causing the objects to become fluidized, i.e., caused to become suspended and float around the chamber. The fluid flow may be turbulent flow, such that the balls move in random motion in the chamber. The chamber is provided with at least one exhaust, which is sized so as to permit balls to occasionally be delivered out of the chamber. In that manner, the chamber with air flowing therethrough and out the exhaust, i.e., the "ball selection machine," functions as a random selector of the balls, which are the objects, contained in the chamber. In other embodiments, the chamber of the ball selection machine may be provided with at least one outlet passageway in a floor thereof, which is sized so as to permit balls to occasionally be delivered out of the chamber by falling and/or rolling into and through the outlet. The balls may pass out of the chamber when the fluidization air flow is slowed or interrupted, and that balls fall back to the floor of the chamber. The above are to be considered examples of ball selections machines; other embodiments are contemplated.

The balls may have indicia, such as letters, numbers, or symbols. The balls may have different properties (such as color), and different shapes. As used herein, the term "balls" is not limited to a spherical shape, but also includes other shapes. The balls may have curvilinear shapes, such as ellipsoid shapes. The balls may have faceted shapes. Accordingly, the various properties and/or indicia of the balls are used to define the collections of objects. As described previously the collections of balls may thus be characterized as belonging to a plurality of categories; each category may contain the same number of balls. The balls within any individual category are all different from each other, i.e. of a different type. Accordingly, all of the balls in the collection of balls are unique, i.e., different from every other ball in the collection, since each ball has its category characteristic and its individual type characteristic in that category. The types within the individual categories may be classified according to a hierarchy, such that the balls within an individual category have values that ascend from a lowest value to a highest value.

In operation of the game, in one exemplary embodiment, a Dealer may be provided with a first ball selection machine and a first collection of ball objects, and a Player may be provided with a second ball selection machine and a second collection of ball objects. The Player's ball collection of ball objects are comprised of at least the same collection of ball objects as the Dealer's collection of ball objects. The game proceeds by the Dealer fluidizing his collection of ball objects in order to make a random selection of the ball objects, and the Player casting or fluidizing his collection of ball objects to make a random selection of ball objects as well. A determination is then made as to whether there is any match. In the event of a match, the House pays funds to the Player, the quantity of which is determined by the probability of the match as described previously herein for other embodiments of the game.

In certain embodiments, the game may be played using one or more computers, wherein software is programmed to create the game virtually, simulating the appearance of the fluidized ball objects, and making random selections of objects for matching, using random number generating algorithms. In another embodiment of the game implemented on a computer, rather than using random number generating algorithm to simulate the selection of the ball objects, the ball selection machine, including the collection of ball objects, the chamber with at least one exhaust and/or outlet port may be created as a virtual model using a three dimensional modeling software program, such as SolidWorks®, ProEngineer®, or Autodesk Inventor®. Additionally, fluid dynamics software may be programmed to simulate the turbulent flow of air through the chamber, the resulting fluidization of the balls therein to cause the balls to move in random motion, and further cause an occasional discharge (i.e., a selection) of a ball from the chamber. By way of illustration, one may use fluidized bed flow simulation software such as that created and sold as Computational Particle Fluid Dynamics software under the trade name BARRACUDA® by CPFD Software LLC of Albuquerque, N. Mex., USA, Other software products that apply a Computational Fluid Dynamics Discreet Element Method (CFD-DEM) model are also suitable. The entire operation of the virtual ball selection machine may be operated by a Player who controls the operation via a user interface.

In embodiments where the game is played using more than one computer, such computers may be in communication via a network. In other embodiments, the game may be played with some Players participating at a physical location using physical ball selection machines, and other Players participating on one or more computers.

Exemplary Embodiments—Polyhedra Versions of Dealer-Player Match Game

Figure 4:
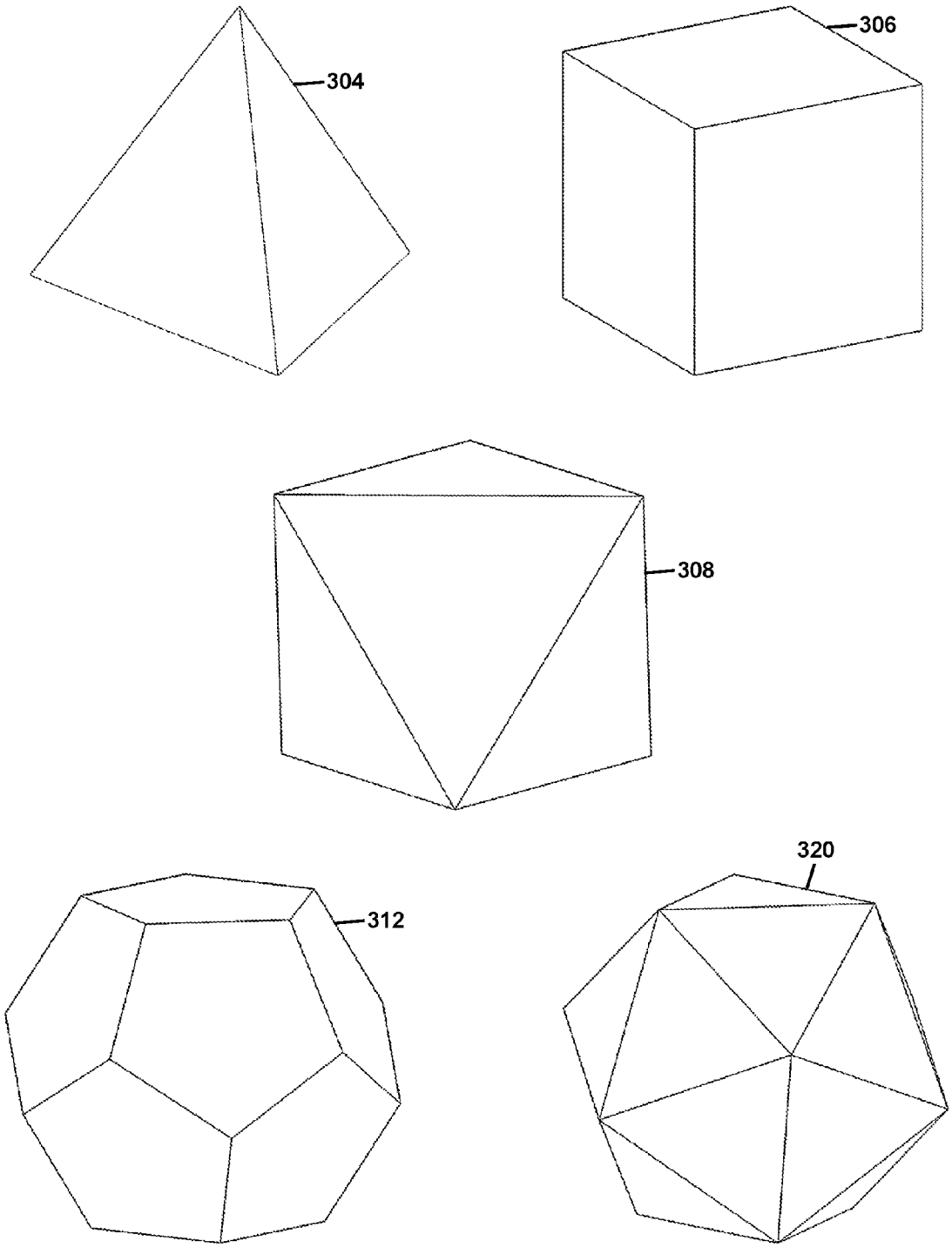
FIG. 4 is a perspective view of various regular polyhedra that may be used in playing an embodiment of a wagering game.

In one aspect of the instant game of chance, the random selection of objects may be performed using polyhedra. The polyhedra may be selected from a class known as Platonic solids, which are regular, convex polyhedra characterized by congruent regular polygonal faces with the same number of faces meeting at each vertex. Referring to FIG. 4, the five Platonic solids are the tetrahedron 304, the cube 306, the octahedron 308, the dodecahedron 312, and the icosahedron 320, having four, six, eight, twelve, and twenty identical faces, respectively. Such solids are particularly suitable because of their symmetry: if the solids are cast like dice (the cubic solid) onto a gaming surface, or temporarily fluidized in a chamber, and then caused to land motionless on the surface, there are equal odds for each side of a given polyhedron being selected in a play.

In a general aspect of a game played with polyhedra, each polyhedron may have indicia on its faces, including numbers, letters, and/or symbols, that define the collection of objects, or a portion thereof. In playing the game in a physical location, the Dealer and each Player are provided with sets of polyhedra. The Player's polyhedra have faces defining at least the same collection of objects as are defined by the faces of the Dealer's set of polyhedra. The game proceeds by the Dealer casting or fluidizing his polyhedra in order to make a random selection of the objects, and the Player casting or fluidizing his polyhedra to make a random selection of objects as well. A determination is then made as to whether there is any match. In the event of a match, the House pays funds to the Player, the quantity of which is determined by the probability of the match as described previously herein for other embodiments of the game.

In certain embodiments, the game may be played using one or more computers, wherein software is programmed to create the game virtually, simulating the appearance of the polyhedra, and making random selections of objects for matching, using random number generating algorithms. In another embodiment of the game implemented on a computer, rather than using random number generating algorithm to simulate the selection of faces of the polyhedra, the polyhedra and gaming table and/or fluidizing chamber may be created as a virtual model using a three dimensional modeling software program as described previously for the ball selection embodiment of the game. Additionally, the software may be used to simulate the casting of the polyhedra onto a gaming surface, where they tumble, thus resulting in random face (object) selections when they stop moving on the gaming surface. Alternatively, fluid dynamics software may be programmed to simulate the turbulent flow of air through the chamber, the resulting fluidization of the balls therein to cause the polyhedra to move in random motion, thus resulting in random face (object) selections when the airflow is ceased and the polyhedra fall to the chamber floor.

In embodiments where the game is played using more than one computer, such computers may be in communication via a network. In other embodiments, the game may be played with some Players participating at a physical location using physical ball selection machines, and other Players participating on one or more computers.

Example—Simulated Card Version of Dealer-Player Match Game Using Octahedra and Dodecahedra In one embodiment of a matching game using polyhedra, the choice of polyhedra enables a simulation of a card game. This embodiment of the game has the advantages that prospective Players are already familiar with playing cards, and the game can be played at a faster pace, because there is no need to perform the shuffling of multiple decks of cards prior to a play. The polyhedra can simply be cast onto a playing surface as dice are, or fluidized (temporarily suspended in midair by an upward air flow) and allowed to land on a surface.

Two identical sets of octahedra and dodecahedra are provided: one set for a Dealer, and one set for a Player. In a "three card" version of the game, three pairs of octahedra and dodecahedra are provided. For any given octahedron-dodecahedron pair, they are correlated with each other, such as by color, or some other visual characteristic. For example, the three pairs may be red, green, and blue octahedron-dodecahedron pairs. For any given pair, the eight sides of the octahedron define the suit, in that opposed pairs of facets are marked spades, diamonds, clubs, and hearts, such that when a play is made, a facet of that octahedron comes up as one of the four suits. (Alternatively, the tetrahedron, having four sides, could be used as the suit selector, but because of its configuration of vertices being opposite to facets, the four vertices would represent the suits.)

The twelve sides of the dodecahedron define the card selection of the suit, from 3-10, and Jack, Queen, King, and Ace. Thus a standard set of playing cards is nearly simulated, with only the two of each suit missing. In an alternative embodiment, octahedron-icosahedron pairs may be used to four suits and the standard thirteen cards. Because the icosahedron has 20 available facets, thirteen of the facets could be numbered 2-10, and Jack, Queen, King, and Ace. The remaining seven facets could include Jokers, other wild cards, duplicates of certain cards, and/or left blank. If blank facets are provided, if one were to be selected in a play, it could be treated as a wild card, as a "no-match," or as requiring a "re-throw."

In playing the game, the Player places a bet of funds as described previously. The Dealer then casts his octahedra/dodecahedra three pairs onto the playing surface. The Player follows by casting his octahedra/dodecahedra three pairs onto the playing surface. The simulated three cards defined by the Player's octahedra/dodecahedra pairs are compared to the Dealer's simulated three cards defined by the Player's octahedra/dodecahedra pairs.

As described previously, if there is no match, i.e. none of that Player's simulated cards share a common suit with any of the Dealer's simulated cards and none of the Player's simulated cards share a common value with any of the Dealer's simulated cards, then the Player loses the bet and the House retains the Player's funds. If there is at least some threshold match between the sets of cards, the House may return the Player's funds and may make a further payout, the amount of which is determined by the degree of match as described previously. It is noted that the "odds" of certain matches will be similar to those described previously in the three-card match game. However, they will not be exactly the same because the simulated card decks are of 48 cards, and not 52 cards. Additionally, since the pairs of octahedra/dodecahedra are independent of each other, it is possible for the same card to be selected by different pairs. (In contrast, in an actual deck of playing cards, once any given card is dealt, it is no longer available to be dealt again in that hand.)

It is noted that the above game may include a growing "bonus jackpot" to be awarded when the lowest probability match occurs, as described previously. Additionally, the game may be played by multiple Players at a physical location. In certain embodiments, the game may be played using one or more computers, wherein software is programmed to create the game virtually, simulating the octahedra/dodecahedra pairs, and making random selections of cards for matching, using random number generating algorithms. In embodiments where the game is played using more than one computer, such computers may be in communication via a network. In other embodiments, the game may be played with some Players participating at a physical location using physical octahedra/dodecahedra pairs, and other Players participating on one or more computers.

Player Decline-or-Accept Match Game Embodiments

In certain embodiments of the games, prior to the selection of the Player's subset of objects randomly selected from the first collection of objects and the selection of the Dealer's subset of objects randomly selected from the second collection of objects (if used in play), the Player has placed a bet of funds against the House that a favorable outcome will occur in the random selection of the subset of objects from the second collection of objects (the Player's objects) as compared to the predefined hierarchy of the objects, i.e., that at least some of his randomly selected objects will be "high quality" objects.

The Player's randomly selected objects may be "dealt", i.e., all selected before revealing any of their identities, or one at a time as play proceeds. In either case, the Player's randomly selected objects from the first collection of objects are compared to the predetermined hierarchy of the objects. In one embodiment of the game, at least one (and possibly several) of the Player's randomly selected objects are revealed, and the comparison is simply to determine whether or not there is any matching of this revealed first portion of the Player's randomly selected objects with the predetermined hierarchy of the objects. One possible outcome is that there is no match between the objects, or no sufficient match to exceed a threshold probability. In this circumstance, the Player loses the bet, and the House retains the wagered funds.

Another possible outcome is that there is at least a partial match of the revealed portion of the Player's randomly selected objects with the predetermined hierarchy of the objects. There is a range of possible matches, such as a match of the same type of objects, and/or a match of the category of objects. In this circumstance, the House may remit the wagered funds back to the Player, and pay an additional amount of funds to the Player. The amount paid depends upon the probability of the particular partial match occurring.

Another possible outcome is that there is an exact match of the Player's revealed portion of the randomly selected objects, or a sufficient match to reach a desired threshold, with the predetermined hierarchy of the objects. In this circumstance, the House offers the Player two options: an option to accept a payout of funds, characterized herein as "Deal;" and an alternative option to decline a payout of funds and continue play, characterized herein as "No Deal." The Options A and B are described in further detail as follows:

Option A: Decide "Deal," i.e., accept a payout of funds based upon the bet wagered prior to the Player's random selection of his subset of objects. The amount of funds paid out depends upon the "quality" of the match to the objects predefined as desirable, and the respective values of the objects selected that are desirable. Higher quality and higher value matches are of lower odds to occur, and thus have a higher payout.

Option B: Decide "No Deal," i.e. decline the above payout of funds, and elect to continue play against the House in an attempt to attain an even greater payout of funds by having at least one of the randomly selected objects continue to match the objects predefined as desirable. In electing this option, the Player risks losing his original wager plus the winnings he would receive if he were to select Option A above, if the next revealed randomly selected object is not a member of the subset of objects that are desirable.

From this point, if the Player selects "No Deal," Option B, play may continue in an iterative manner. The next object (or subset of objects) from the remaining randomly selected objects of the Player's collection is revealed. If this next object is not a predetermined high quality desired object, the Player loses, and the House retains the Player's wagered funds and his accrued winnings. If this next object is a predetermined high quality desired object, the House then offers Options A, "Deal," accept accrued winnings; or Option B, "No Deal," wager accrued winnings and continue play. At any point at which a next revealed object of the Players randomly selected objects from his collection does not match a high quality predetermined object, the Player loses. The House retains his original wager and all accrued winnings, and the game ends. In one embodiment of the game, if a point is reached at which the Player has continued to wager, and he wins on every single play to the point where his entire collection of randomly selected objects has been revealed and matches an entire predetermined subset of quality objects, then the Player wins the maximum possible jackpot for the game, and the game ends.

In another embodiment, if the Player has continued to wager, and he has won on every single play to the point where his entire collection of randomly selected objects has been revealed and matches an entire predetermined subset of quality objects, he is presented with Option A or Option B above, but to continue to play via Option B, the Dealer is provided with a collection of objects, and a subset of randomly selected objects is made from the Dealer's collection. The game then continues in the above described iterative manner, with revealed objects from the Dealer's randomly selected subset being revealed each time Option B is chosen. At any point at which a next revealed object of the Dealer's randomly selected objects from his collection does not match a high quality predetermined object, the Player loses. The House retains his original wager and all accrued winnings, and the game ends. If a point is reached at which the Player has continued to wager, and he wins on every single play to the point where The Dealer's entire collection of randomly selected objects has been revealed and matches an entire predetermined subset of quality objects, then the Player wins the maximum possible jackpot for the game, and the game ends.

It will be apparent that the winning of the lowest probability/highest jackpot payout outcome will be a rare occurrence, and will have a payout much higher than other payouts for other winning occurrences. It will be further apparent that the game may be played over and over again, perhaps millions of times, without this lowest probability/highest jackpot payout outcome occurring. In certain embodiments, to make the game more attractive to prospective Players, each time the game is played, and the lowest probability/highest payout outcome does not occur, the House incrementally increases the payout for the next occurrence of that outcome. Thus the maximum payout includes a pool of funds that continually increases until a Player achieves the lowest probability winning outcome, i.e. "hits the jackpot."

Figure 5:
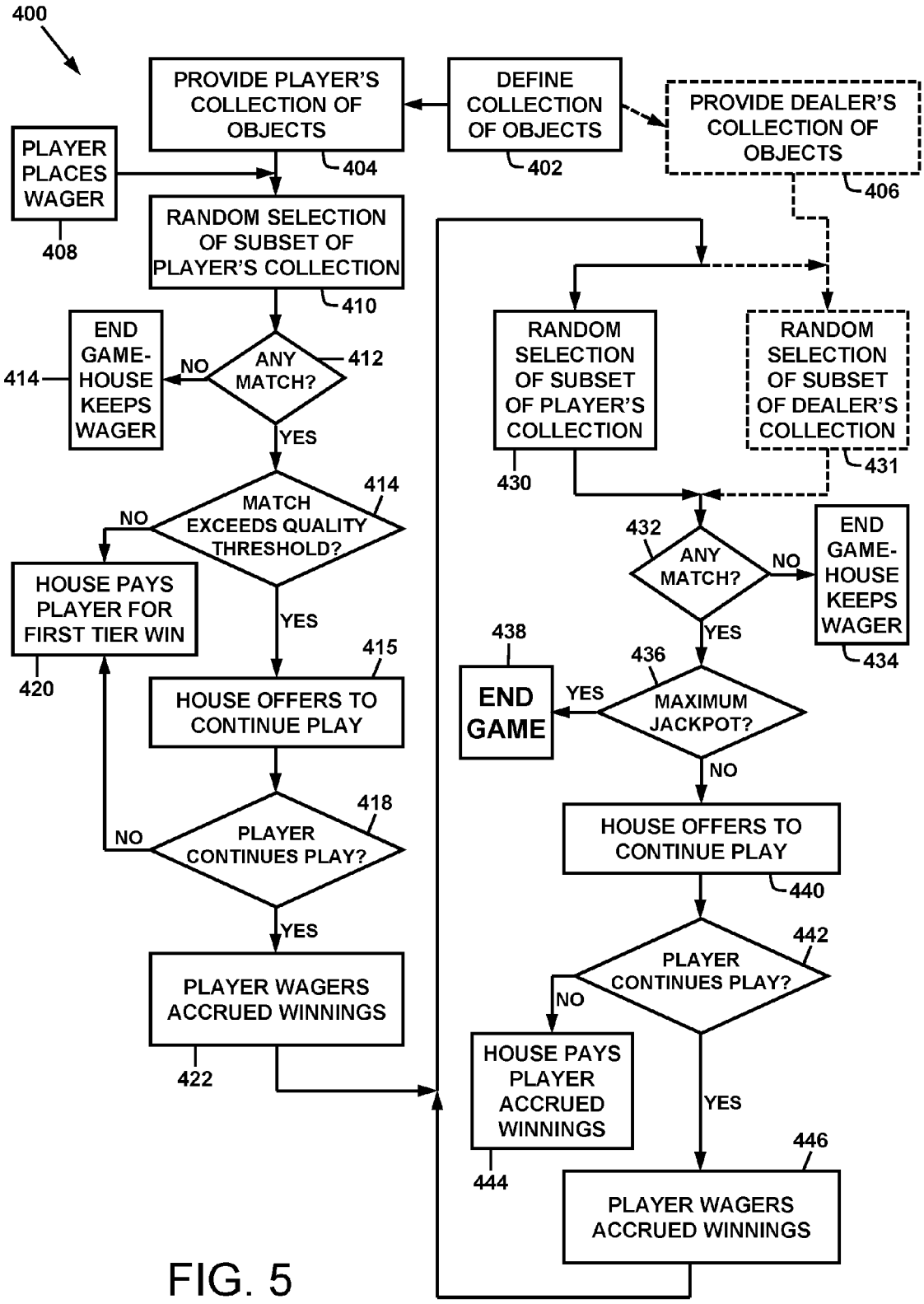
FIG. 5 is a flowchart depicting additional embodiments of wagering games of the present disclosure in a generalized manner.

To further illustrate the above generalized disclosure of the game, FIG. 5 is a flowchart that depicts the creation and playing of the game as a wagering game. The game 400 is created by first defining 402 the collection of objects to be used in playing the game. Categories of objects are defined, and the types of objects within the categories are also defined. A hierarchy of value of the types of objects may also be defined. The categories may also be classified according to a hierarchy of values.

Collections of the objects are also provided. In an embodiment in which only a single Player plays the game, a first collection of objects is provided 404. If additional parties are playing the game, additional Players' collections of objects (not shown) are provided. If play may proceed at some point with a Dealer playing randomly selected objects, a collection of objects may be provided 406 to the Dealer. The collections of objects may be of physical objects, with the parties playing the game at a physical location and using other elements such as a predefined playing surface. Alternatively, the collections of objects may be of virtual objects, with the parties playing the game using user interface devices in communication with a computer, which contains a software program to execute the game. Alternatively, some of the collections of objects may be of physical objects, with the parties playing the game at a physical location, while other parties are playing the game using user interface devices in communication with a computer (not shown). In this case, the computer provides virtual collections of objects to the parties playing via the computer. Implementation of the game 400 using a computer may be performed as disclosed in the aforementioned U.S. Provisional Patent Application No. 62/182,100.

To begin the game 400, the Player (second party) places a wager or bet of funds 408 against the House (first party) on a favorable outcome in the subsequent random selection of objects from his collection 404 of objects. Any additional wagering parties playing physically place their bets, and any additional wagering parties playing virtually place their bets.

With bets placed, a random selection 410 of a subset of objects from the Player's collection 404 is made. If additional Players are playing the game, additional subsets are selected for the additional Players from their collections of objects. If a Dealer is controlling the game, the Dealer may make the selections, or the individual Players may make their selections. If a computer is operating the game, the computer makes the selections, following an input prompt communicated to the wagering Player parties. If a Dealer is controlling the game at a physical location, and additional parties are playing via communication with a computer, the computer makes additional random selections of subsets of virtual objects from the respective virtual collections, following an input prompt communicated to the Players playing virtually.

The randomly selected subset 410 of the Player's collection of objects is then compared 412 to determine if the outcome is that there is any match with objects of the collection that are predetermined to be of high quality. If there is no match, the Player loses, and the House keeps 414 the funds wagered. If there is at least some match, the degree of match is quantified 415. At step 416, the House offers the Player Options A and B described previously. At point 418, the Player either chooses Option A, accepting a payout 420 of the winnings for his match up to this point; or Option B, to wager 422 his accrued winnings and original wager and continue play. If the Player chooses Option A, the House remits the Player's wager 408 back to him/her, and further pays 420 the Player an additional sum of funds for a winning outcome. The additional sum of winnings is correlated with the probability for the particular matching outcome, with winnings payments varying inversely with probability.

Referring again to gate 414 of FIG. 5, in certain embodiments of the game, the House rules may stipulate that for the Player to have the option to continue play in pursuit of a higher level of payout, the quality of the match between the Player's randomly selected objects and the subset of predetermined high quality objects must exceed a certain threshold. If the match does not exceed the threshold, the House simply returns the original wager to the Player and pays additionally for the match achieved inversely proportional with odds as described above, and the game is terminated.

If the Player elects Option B, to continue play, then a further random selection 430 of objects from the Players collection of objects may be performed. Alternatively, there may be remaining objects from the selection 410 that have not yet been revealed, and are available for further play. In an alternative embodiment, the Dealer may be provided with a collection of objects 406, and a subset of randomly selected objects made 431 from the Dealer's collection. Further play may continue with the subset of randomly selected objects made from the Dealer's collection. In any event, at least one more randomly selected object from the Player's collection or the Dealer's collection (if used) is revealed, and a determination 432 is made as to whether there is a match with the predetermined high quality objects. If there is no match, play ends 434, and the House keeps the Player's wager. If there is a match, an additional determination 436 is made as to whether all of the randomly selected objects have been matched to all of the available for further play. In this situation, the Player has won the maximum jackpot, and the game ends 438. If there are remaining unrevealed randomly selected objects available for further play, the House again offers 440 the Player Options A and B described previously. At point 442, the Payer either chooses Option A, accepting a payout 444 of the winnings for his match up to this point; or Option B, to wager 446 his accrued winnings and original wager and continue play. If the Player chooses Option A, the House remits the Player's wager and accrued winnings back to him/her, and further pays 444 the Player an additional sum of funds for a winning outcome. If the Player chooses Option B, to wager 446 his accrued winnings, the game proceeds again with another randomly selected object 430 from the Player's collection, or a randomly selected object 431 from the Dealer's collection. Play may continue iteratively through steps 430-446 until the Player loses a wager, thus losing his accrued winnings and ending the game 434, or until the Player achieves matches of all of the randomly selected objects with the predetermined high quality objects, and ends the game 438 by winning the maximum jackpot.

As described previously, there may be a single maximum jackpot payout for the winning outcome that has the lowest probability of occurring. In such an embodiment, an additional check may be performed to determine if the lowest probability "jackpot match" outcome has occurred. If such jackpot match has occurred, the House may further pay accumulated funds in a bonus jackpot to the Player. If such jackpot match has not occurred, the House may add an incremental amount of funds to the jackpot. In that manner, as the jackpot continually grows over time until the lowest probability "jackpot match" outcome occurs, the game 400 becomes more attractive for parties to engage in play.

As stated previously, multiple Players may play the game, with each Player being assigned a collection of objects, and each Player (or the Dealer) making a random selection of a subset of the objects. Play proceeds for each Player until accrued winnings are accepted from the House, or the Player loses his wager and ends play, or the Player wins the maximum jackpot. The entire above scenario may be played out in a physical location with physical objects and may be controlled by a Dealer, or it may be implemented on a computer. In a further embodiment, if additional parties are playing the game virtually, their subsets of virtual collections of objects are compared 48 with the predetermined subset of high quality objects. For those additional Players having no matches, their funds are kept by the House. For those Player having at least some match, they are offered Options A and B as described above. Additionally, any virtual Player who has the lowest probability "jackpot match" sequence of winning outcomes receives the payment of the jackpot, and in the event that no additional Player wins the jackpot, the House may add incremental amounts of funds to the jackpot in proportion to the number of additional parties that played but did not win the jackpot. With this portion of the game and the interaction with the Players playing the game virtually being implemented on a computer, the transfers of funds from the Players to the House and vice versa may also be implemented via the computer, i.e. as electronic funds transactions.

In additional embodiments, versions of the game are provided in which the funds wagered have a non-monetary value, such as for recreational home and family use. The funds may be "play money" (like MONOPOLY® money), or any other representation of money of something else of value. Alternatively, the "non-monetary" funds may simply be numerical values, with scoring in the game based upon the probability of the occurrences of the various matches that are possible in the game. Such embodiments may be packaged physical versions of the game sold to consumers as physical retail products, or virtual versions playable on personal computers, tablets, smartphones, and other portable computing devices. Additionally such versions of the games may be played by multiple parties on computing devices that are in communication with each other via a network. All of the exemplary embodiments of the game described herein, as well as other embodiments not described but falling under the broad concept of the game may be provided as non-wagering embodiments. In such embodiments, rather than wagered funds won or lost as the metric of success in playing the game, other non-monetary scoring systems may be devised.

Exemplary Embodiment—Card Version of Player Decline-or-Accept Game

In one aspect of the instant game of chance, the collections of objects may be cards. The cards have a category characteristic, and within each category, a type characteristic. The type characteristics are the same within each category. The type characteristics may be assigned a hierarchy of values.

Although an endless variety of collections of cards may be used, in certain embodiments, a standard deck of playing cards may be used, i.e., a deck of cards comprised of four suits, Spades (S), Diamonds (D), Clubs (C), and Hearts (H), each suit having cards 2-10, Jack (J), Queen (Q), King (K), and Ace (A). The deck of playing cards may further include additional cards, such as Jokers, which may function as "wild" cards. Exemplary embodiments of card versions of the game will now be described as being played with a standard deck of cards. However, it is to be understood that the card versions of the instant game may be played with other collections of cards.

Figure 6A:
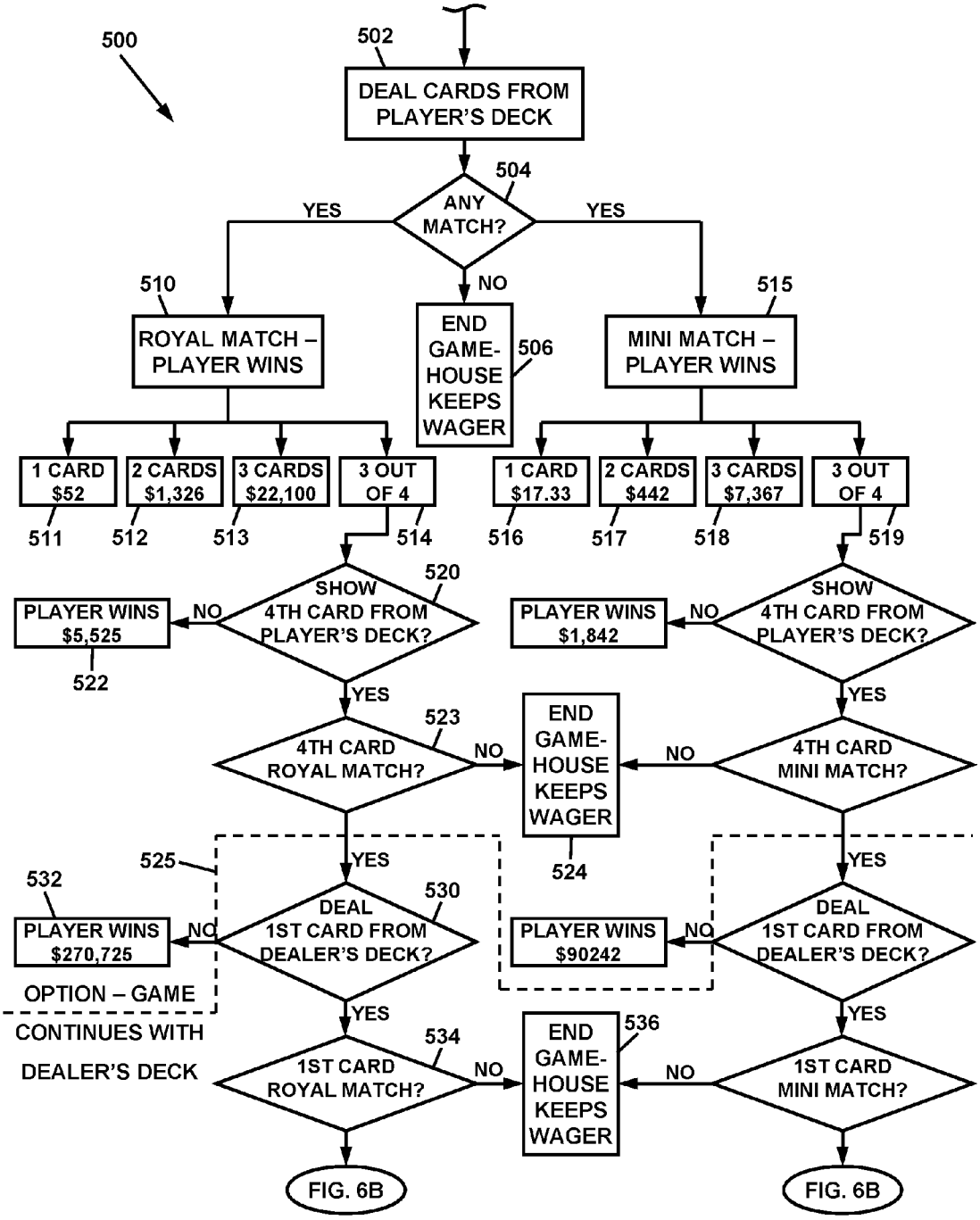
FIGS. 6A and 6B depict a flowchart of embodiments of wagering games of FIG. 5 that are played using playing cards, with FIG. 6A depicting a first portion of the game, and FIG. 6B depicting a second portion of the game.
Figure 6B:
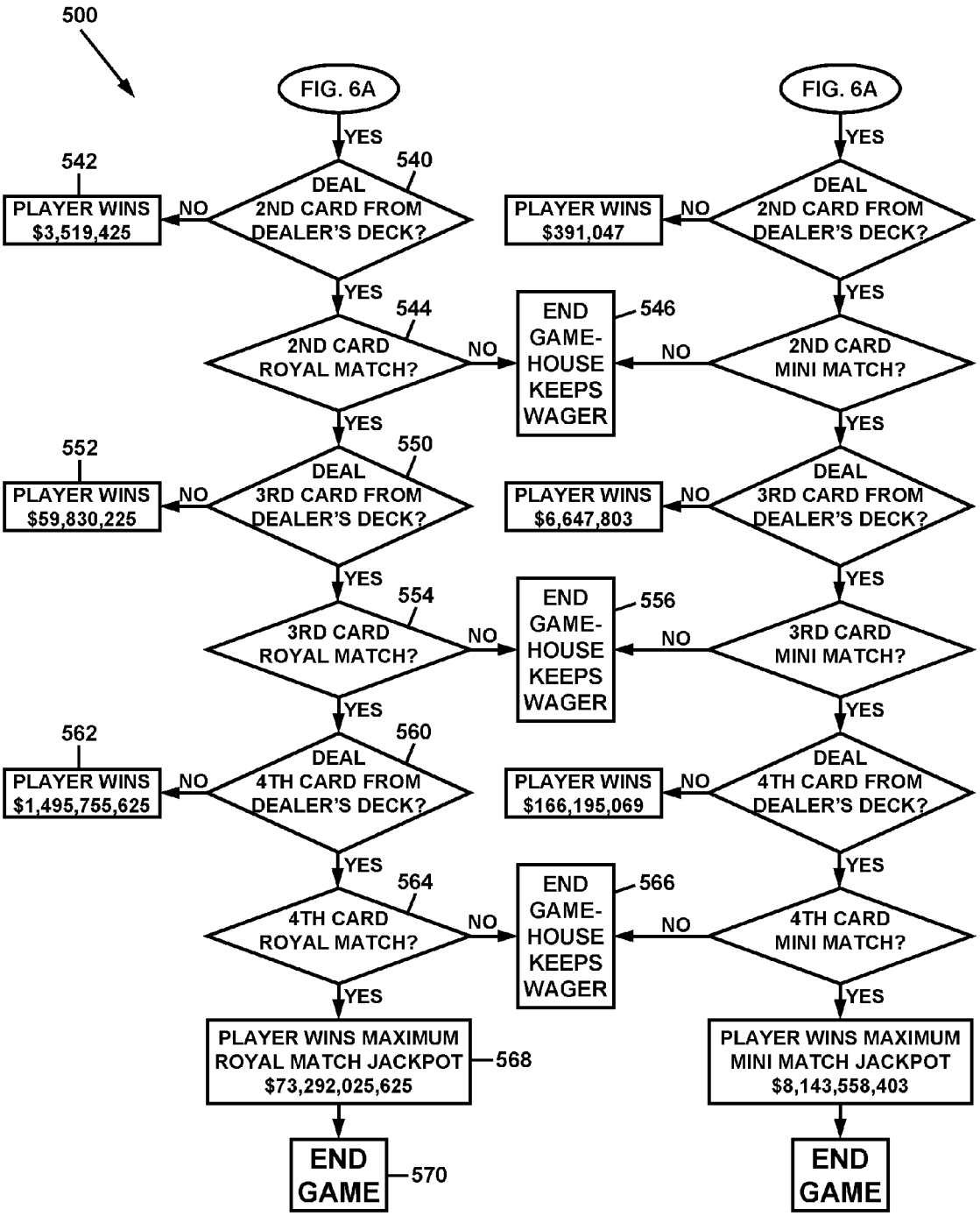

FIGS. 6A and 6B depict a flowchart of one exemplary embodiment of wagering games of the present disclosure that are played using playing cards, with FIG. 6A depicting a first portion of the game, and FIG. 6B depicting a second portion of the game. It is to be understood that this embodiment as depicted in FIGS. 6A and 6B is meant to be exemplary and not limiting. Many other embodiments of the game as broadly described herein are contemplated. Referring to FIG. 6A, steps 402, 404, and 406 (as described with reference to FIG. 5) are not shown. The collections of Players and Dealer's objects are embodied in decks of cards, with the categories being the four suits, the types of cards being cards A, 2-10, J, Q, and K, with values per the commonly recognized hierarchy in the above recited order. In this example, the royal cards, King, Queen, and Jack, and the 10 (K, Q, J, 10) are considered to be the "high quality" cards, for which matching with randomly selected cards is desired.

TABLE 2 (divided into PARTS A and B) further depicts the various odds for the embodiment of the card version game summarized in FIGS. 6A and 6B. It is noted that the various payouts for wagers are calculated based on a wager of one dollar by the Player. Additionally, the payouts shown are simply based upon the odds of the various matches occurring during the game. The payouts are not reduced to allow a profit margin by the House. It is to be understood that in the operation of the game by a casino or other business enterprise, that the payouts would be reduced by some amount to provide a profit margin for the House. (If this were not the case, over "infinite time" playing the game, the House and Players would simply break even.

TABLE 2

PART A. Summary of odds and payouts for card embodiment of game played with two separate card decks. (Columns W-AG continued on next page in PART B.)

| | A | K | L | M | N | O | P | Q | R | S | T | U | V |
|---|---|---|---|---|---|---|---|---|---|---|---|---|---|
| 1 | | | | | | PLAYER | | | | | | | |
| 2 | MATCH TYPE | Using 2 Single Decks | | | | | | | | | Odds to 1 | | |
| 3 | | | | | | | | | | | | | |
| 4 | Royal Match | 1 Card KH | | 52 | | | | | | | | 52 | |
| 5 | | | | 1 | 52 | $52.00 | | | | | $52.00 | 1 | 52 |
| 6 | | | | | | | | | | | | | |
| 7 | Royal Match | 2 Cards KH, QH | # of Cards | 52 | 51 | 2,652 | | | | | | 52 | |
| 8 | | | Possibilities | 2 | 1 | 2 | $1,326.00 | | | | $1,326.00 | 2 | $68,952.00 |
| 9 | | | | | | | | | | | | | |
| 10 | Royal Match | 3 Card KH, QH, JH | # of Cards | 52 | 51 | 50 | 132,600 | | | | | 52 | |
| 11 | | | Possibilities | 3 | 2 | 1 | 6 | $22,100.00 | | | $22,100.00 | 3 | $1,149,200.00 |
| 12 | | | | | | | | | | | | | |
| 13 | Royal Match | 4 Card KH, QH, JH, 10H | # of Cards | 52 | 51 | 50 | 132,600 | | 49 | | | 52 | |
| 14 | | | Possibilities | 4 | 3 | 2 | 24 | $5,525.00 | 1 | 270,725 | $270,725.00 | 4 | $14,077,700.00 |
| 15 | | | | | | | | | | | | | |
| 16 | | | | | | | | | | | | | |
| 17 | Mini Match | 1 Card K, /S, D, C | # of Cards | 52 | | | | | | | | 52 | |
| 18 | | | Possibilities | 3 | 17.33 | $17.33 | | | | | $17.33 | 3 | 17.333 |
| 19 | | | | | | | | | | | | | |
| 20 | Mini Match | 2 Cards K, Q, /S, D, C | # of Cards | 52 | 51 | 2,652 | | | | | | 52 | |
| 21 | | | Possibilities | 6 | 1 | 6 | $442.00 | | | | $442.00 | 6 | $22,984.00 |
| 22 | | | | | | | | | | | | | |
| 23 | Mini Match | 3 Cards K, Q, J, /S, D, C | # of Cards | 52 | 51 | 50 | 132,600 | | | | | 52 | |
| 24 | | | Possibilities | 9 | 2 | 1 | 18 | $7,366.67 | | | $7,366.67 | 9 | $383,066.67 |
| 25 | | | | | | | | | | | | | |
| 26 | Mini Match | 4 Cards K, Q, J, 10/ S, D, C | # of Cards | 52 | 51 | 50 | 132.600 | | 49 | | | 52 | |
| 27 | | | Possibilities | 12 | 3 | 2 | 72 | $1,841.67 | 1 | 90,242 | $90,241.67 | 12 | $4,692,566.67 |

TABLE 2-continued

PART B. (Continued from columns A-V in PART A on preceding page.)

Summary of odds and payouts for card embodiment of game played with two separate card decks.

| W | X | Y | Z | AA | AB | AC | AD | AE | AG |
|---|---|---|---|---|---|---|---|---|---|
| | | DEALER Using 2 Single Decks | | | 2 Deck Match | | | | Odds to 1 |
| $52.00 | | | | | | | | | $2,704.00 |
| | 51 | | | | | | | | |
| $34,476.00 | 1 | $1,758,276.00 | 1,758,276 | | | | | | $1,758,276.00 |
| | 51 | | | 50 | | | | | |
| $383,066.67 | 2 | $19,536,400.00 | $9,768,200.00 | 1 | 488,410,000 | | | | $488,410,000.00 |
| | 51 | | | 50 | | | 49 | | |
| $3,519,425.00 | 3 | 179,490,675 | 559,830,225.00 | 2 | 2,991,511,250 | $1,495,755,625.00 | 1 | 73,292,025,625 | $73,292,025,625.00 |
| $17.33 | | | | | | | | | $300.44 |
| | 51 | | | | | | | | |
| $3,830.67 | 1 | 195,364 | $195,364.00 | | | | | | $195,364.00 |
| | 51 | | | 50 | | | | | |
| $42,562.96 | 2 | 2,170,711 | $1,085,355.56 | 1 | 54,267,778 | $54,267,777.78 | | | $54,267,777.78 |
| | 51 | | | 50 | | | 49 | | |
| $391,047.22 | 3 | 19,943,408 | $6,647,802.78 | 2 | 332,390,139 | $166,195,069.44 | 1 | $8,143,558,402.78 | $8,143,558,402.78 |

Referring to FIG. 6A, and in the game 500 depicted therein, a first deck of cards is considered as being assigned to the Player, and a second card deck is assigned to the Dealer, who controls the game on behalf of the House when the game is played live (i.e. not by a computer). Thus this embodiment of the game is played using two single decks, as noted at the top of TABLE 2. If additional Players are playing the game, additional card decks are assigned to them, and play proceeds as will be described herein for the game played by a single Player.

To begin the game, the Player places a bet of funds 408 (FIG. 5) against the House on a favorable outcome of at least some match of randomly selected cards from his deck matching the predefined "high quality" royal cards of K, Q, J, and/or 10 of the four suits. Any additional Players playing physically place their bets, and any additional Players playing virtually place their bets.

In the game 500 played in a physical location, the game 500 may be controlled by a Dealer (not shown), who makes a random selection of a subset of cards from the first deck. To make the random selection, the first deck of cards may be shuffled, and then the desired number of cards is dealt off the top of the deck. Other random card selection techniques may be used. If more than one card is dealt to the Player, the cards are dealt face down such that their identity is not revealed.

If additional Players are playing the game, additional subsets are selected from the respective additional card decks for the additional parties. If a Dealer is controlling the game, the Dealer may make the selections; or the individual parties may make their selections. If a computer is operating the game, the computer makes the selections using a random number generating algorithm, following an input prompt communicated to the respective additional Players.

If a Dealer is controlling the game at a physical location, and additional parties are playing via communication with a computer (not shown in FIGS. 6A/6B), the computer makes additional random selections of subsets of virtual cards from the respective virtual card decks using a random number generating algorithm, following an input prompt communicated to the parties playing virtually. In one embodiment of first Players at a physical location and second Players playing via communication with a computer, a video camera is provided with image processing software, wherein an image of the subsets of cards at the physical location of the game is captured and processed. Via an optical character recognition algorithm, any cards dealt from Dealer's deck and subsequently revealed during play are recognized and uploaded into the gaming program in the computer. The computer then completes play of the game with those Players playing virtually as described immediately below. In that manner, those Players playing virtually can enjoy the excitement of playing the game as if they were at the physical location.

In step 502, cards are dealt from the Player's deck to produce a randomly selected subset of his cards. The number of cards dealt depends on the rules of the game set by the House. In the exemplary embodiment of the game 500 depicted in FIGS. 6A and 6B, three of the Player's cards are dealt face down, i.e., their identities are not known. The Player then chooses three of the four cards and turns them over. The three revealed cards are then assessed to determine if the outcome 504 is that there is any match with the desired royal cards K, Q, J, and 10. If there is no match, Player loses, the House keeps 506 the funds wagered, and the game ends (for that Player—other Players with matches may be able to continue play).

If there is at least some match, the degree of match is quantified as predefined by calculation of the probability of the particular match. In general, there are two types of matches 510 and 515 as shown in FIG. 6A and listed in TABLE 2. The "Royal Match" is a match where the highest value suit of Hearts (as defined by the House), is matched. The probabilities of the Player having one, two, or three of the cards KH, QH, JH, or 10H are 52:1, 1,326:1, and 22,100, respectively. The "Mini Match" is a match where the lesser suits of Spades, Diamonds, or Clubs are matched. The probabilities of the Player having one, two, or three of the cards K, Q, J, or 10 of any of the other suits are 17.33:1, 442:1, and 7,366.67:1, respectively. (It is noted that in TABLE 2, in the Odds to 1 columns, and in FIGS. 6A and 6B, all payouts are listed as per dollar wagered. However, as stated previously, the actual payouts would be discounted by an amount to allow for a profit margin by the House.)

1 card, 2 card, and 3 card Royal Matches 511, 512, and 513, and 1 card, 2 card, and 3 card Mini Matches 516, 517, and 518 are shown in FIG. 6A. In the event of such outcomes, the House remits the Players wager back to him/her, and further pays the Player an additional sum of funds for a winning outcome. However, it is noted that if all three of the Player's revealed cards are three of the four cards for a full Royal or Mini Match, those circumstances trigger "3 out of 4" thresholds 514 and 519. The Player is presented with the "Deal or No Deal" Options A and B as described previously. The situation for the Royal Match as set forth in FIGS. 6A and 6B and Rows 1-14 of TABLE 2 will now be described in detail, with it being understood that the description also applies to the Mini Match shown in Rows 17-27 of TABLE 2 and the right side of FIGS. 6A and 6B. The following description also applies to additional Players engaged in the game at the physical location of the game or playing virtually on a computer.

Upon attaining a 3 of 4 card Royal Match, at decision point 520, the House offers the Player Option A, to stop play and accept a payout 522 of his accrued winnings; or Option B, to continue play by turning over his fourth card. If the Player chooses to continue play, the revealed fourth card is evaluated 523 to determine if it is the remaining card required for a complete four card Royal Match. If it is not, the House keeps the Player's original wager and accrued winnings, and the game ends 524.

If it is the required card, and the four card Royal Match is attained, the Option A/Option B "Deal/No Deal" cycle begins again. However, because the Player's four cards are all now revealed, the game continues with the Dealer's deck of cards being used for further play, as indicated by dotted line 525. The Player decides 530 whether or not to continue play and have the Dealer deal the first card from his deck. If the Player chooses option A, the Player accepts his accrued winnings 532, and the game ends. If the Player chooses Option B, play continues with the Dealer dealing his first card. The Dealer's first card is evaluated 534 to determine if it is one of the four cards required for a second Royal Match. If it is not, the House keeps the Player's original wager and accrued winnings, and the game ends 536. If it is one of the required cards, and the four card Royal Match remains attainable, the Option A/Option B Deal/No Deal cycle continues.

The Player decides 540 whether or not to continue play and have the Dealer deal the second card from his deck. If the Player chooses option A, the Player accepts his accrued winnings 542, and the game ends. If the Player chooses Option B, play continues with the Dealer dealing his second card. The Dealer's second card is evaluated 544 to determine if it is one of the remaining three cards required for a second Royal Match. If it is not, the House keeps the Player's original wager and accrued winnings, and the game ends 546. If it is one of the required cards, and the four card Royal Match remains attainable, the Option A/Option B Deal/No Deal cycle continues.

The Player decides 550 whether or not to continue play and have the Dealer deal the third card from his deck. If the Player chooses option A, the Player accepts his accrued winnings 552, and the game ends. If the Player chooses Option B, play continues with the Dealer dealing his third card. The Dealer's third card is evaluated 554 to determine if it is one of the remaining two cards required for a second Royal Match. If it is not, the House keeps the Player's original wager and accrued winnings, and the game ends 556. If it is one of the required cards, and the four card Royal Match remains attainable, the Option A/Option B Deal/No Deal cycle continues.

The Player decides 560 whether or not to continue play and have the Dealer deal the fourth card from his deck. If the Player chooses option A, the Player accepts his accrued winnings 562, and the game ends. If the Player chooses Option B, play continues with the Dealer dealing his fourth card. The Dealer's fourth card is evaluated 564 to determine if it is the remaining card required for a second Royal Match. If it is not, the House keeps the Player's original wager and accrued winnings, and the game ends 566. If it is one of the required cards, the Player winds the maximum Royal match jackpot 568, and the game ends 570.

As stated previously, the entire above scenario may be played out in a physical location with physical decks of cards and may be controlled by a Dealer, or it may be implemented on a computer. Combinations of live play and virtual play may be implemented though the use of image processing and character recognition software on a computer as described previously.

TABLE 3 (divided into PARTS A and B) presents a summary of the odds, procedures, and payouts (undiscounted, i.e. sans discount for House profit margin) for an embodiment of the game played with two card decks contained in a single shoe. The manner in which the payouts vary with this embodiment will be apparent from a study of TABLE 3. The manner in which the game of TABLE 3 proceeds is analogous to the game 500 depicted in FIGS. 6A and 6B and TABLE 3, and will not be described in detail here. The main difference between the games of TABLE 3 and TABLE 3 are that in the game of TABLE 3 with two decks combined in a single shoe, all cards for the pursuit of two royal matches are dealt from the single shoe, and the payout odds vary accordingly per TABLE 3 due to the combining of the two decks of cards.

TABLE 3

PART A. Summary of odds and payouts for card embodiment of game played with two card decks combined in a single shoe.
(Columns W-AG continued on next page in PART B.)

| | A | K | L | M | N | O | P | Q | R | S | T | U | V |
|---|---|---|---|---|---|---|---|---|---|---|---|---|---|
| 1 | | | | | PLAYER | | | | | | | | |
| 30 | MATCH TYPE | Using 1 Shoe 2 Decks | | | | | | | | | | | |
| 31 | | | | | | | | | | | | | |
| 32 | Royal Match | 1 Card KH | # of Cards | 104 | | | | | | | | 103 | |
| 33 | | | Possibilities | 2 | 52 | $52.00 | | | | | $52.00 | 1 | 103 |
| 34 | | | | | | | | | | | | | |
| 35 | Royal Match | 2 Cards KH, QH | # of Cards | 104 | 103 | 10,712 | | | | | | 102 | |
| 36 | | | Possibilities | 4 | 2 | 8 | $1,339.00 | | | | $1,339.00 | 2 | $136,578.00 |
| 37 | | | | | | | | | | | | | |
| 38 | Royal Match | 3 Card KH, QH, JH | # of Cards | 104 | 103 | 102 | 1092.624 | | | | | 101 | |
| 39 | | | Possibilities | 6 | 4 | 2 | 48 | $22,763.00 | | | $22,763.00 | 3 | $2,299,063.00 |
| 40 | | | | | | | | | | | | | |
| 41 | Royal Match | 4 Card KH, QH, JH, 10H | # of Cards | 104 | 103 | 102 | 1,092,624 | | 101 | | | 100 | |
| 42 | | | Possibilities | 8 | 6 | 4 | 192 | $5,690.75 | 2 | $574,765.75 | $287,382.88 | 4 | $28,738,267.50 |
| 43 | | | | | | | | | | | | | |
| 46 | Mini Match | 1 Card K, /S, D, C | # of Cards | 104 | | | | | | | | 103 | |
| 47 | | | Possibilities | 6 | 17.33 | $17.33 | | | | | | 1 | 103 |
| 48 | | | | | | | | | | | | | |
| 49 | Mini Match | 2Card K, Q, /S, D, C | # of Cards | 104 | 103 | 10,712 | | | | | | 102 | |
| 50 | | | Possibilities | 12 | 2 | 24 | $446.33 | | | | | 2 | $45,525.00 |
| 51 | | | | | | | | | | | | | |
| 52 | Mini Match | 3 Cards K, Q, J, /S, D, C | # of Cards | 104 | 103 | 102 | 1,092,624 | | | | | 101 | |
| 53 | | | Possibilities | 18 | 4 | 2 | 144 | $7,587.67 | | | $7,587.67 | 3 | 766,354.33 |
| 54 | | | | | | | | | | | | | |
| 55 | Mini Match | 4 Cards K, Q, J, 10/ S, D, C | # of Cards | 104 | 103 | 102 | 1,092,624 | | 101 | | 100 | | |
| 56 | | | Possibilities | 24 | 6 | 4 | 576 | $1,896.92 | 2 | $191,588.58 | $95,794.29 | 4 | 9,579,429.17 |

TABLE 3-continued

PART B. (Continued from columns A-V in PART A on preceding page.)

Summary of odds and payouts for card embodiment of game played with two card decks combined in a single shoe.

| W | X | Y | Z | AA | AB | AC | AD | AE | AG |
|---|---|---|---|---|---|---|---|---|---|
| | | DEALER Using 1 Shoe 2 Decks | | | 1 Shoe Match | | | | |
| $103.00 | | | | | | | | | $5,356.00 |
| | 101 | | | | | | | | |
| $68,289.00 | 1 | $6,897,189.00 | $6,897,189.00 | | | | | | $6,897,189.00 |
| | 100 | | | 99 | | | | | |
| $766,354.33 | 2 | $76,635,433.33 | $38,317,716.67 | 1 | $3,793,453,950.00 | | | | $3,793,453,950.00 |
| | 99 | | | 98 | | | 97 | | |
| $7,184,571.88 | 3 | $711,272,615.63 | $237,090,871.88 | 2 | $23,234,905,443.75 | $11,617,452,721.88 | 1 | $1,126,892,914,021.87 | $1,126,892,914,021.87 |
| $103.00 | | | | | | | | | $1,785.33 |
| | 101 | | | | | | | | |
| $22,763.00 | 1 | $2,299,063.00 | $2,299,063.00 | | | | | | |
| | | | | | | | | | $2,299,063.00 |
| | 100 | | | 99 | | | | | |
| $255,451.44 | 2 | $25,545,144.44 | $12,772,572.22 | 1 | $1,264,484,650.00 | | | | |
| | | | | | | | | | $1,264,484,650.00 |
| | 99 | | | 98 | | | 97 | | |
| $2,394,857.29 | 3 | $237,090,871.88 | $79,030,290.63 | 2 | $7,744,968.481.25 | $3,872,484,240.63 | 1 | $375,630,971,340.63 | $375,630,971,340.63 |

Exemplary Embodiment—Chambered Object Selector ("Keno") Version of Player Decline-or-Accept Game In one aspect of the instant game of chance, the random selection of objects may be performed wherein the objects are contained in a chamber, as described in the aforementioned U.S. Provisional Patent Application No. 62/182,100. This embodiment of the game may be considered as a "Keno"-like version of the game. In operation of the game, in one exemplary embodiment, a Player may be provided with a first ball selection machine and a first collection of ball objects, and a Dealer may be provided with a second ball selection machine and a second collection of ball objects. The Player's ball collection of ball objects are comprised of at least the same collection of ball objects as the Dealer's collection of ball objects. The game proceeds by the Player casting or fluidizing his collection of ball objects to make a random selection of ball objects. A determination is then made as to whether there is a match of the Player's randomly selected objects with objects that are predetermined to be of high quality. Alternatively, the Dealer may cast or fluidize his collection of ball objects to make a random selection of ball objects. A determination is made as to whether the Player's objects match the Dealer's objects. In the event of a match in either embodiment of the game, the House pays funds to the Player, the quantity of which is determined by the probability of the match as described previously herein for other embodiments of the game. Additionally, if there is a match of sufficiently high quality, the House may offer the Player the "Deal/No Deal" Options A and B described previously. Play may continue with a sequence of Option A/Option B scenarios, until the Player loses, or the Player wins the maximum jackpot.

In certain embodiments, the Keno-style game with deal or no-deal Player decisions has some similarity to the standard Keno game. The Player may pick Keno numbers from a standard Keno card. In certain embodiments, the Player may pick a specified number of Keno numbers to include five or ten numbers. The Dealer then picks the same number of Keno numbers one at a time. After each Dealer pick and match with a Player, the Player has the choice to receive a payout for that and previous matches, A DEAL, or to continue to play, A NO-DEAL, to see if the next Keno number of the Dealer matches one of his Keno numbers with higher payouts if there is a match. This continues until the Dealer has selected the equivalent number of Keno numbers as the Player picked originally.

Variations of this Keno-style DEAL or NO-DEAL game include multiple Keno number matches within the DEAL or NO-DEAL Player decisions. In one embodiment, the Player selects two Keno numbers, and then the Dealer selects two Keno numbers. If they both match, the Player decides whether to accept the DEAL payout; or not, i.e., NO-Deal. If NO-Deal is chosen the Player selects two more Keno-numbers followed by the Dealer selection of two Keno numbers and a subsequent DEAL or NO-DEAL decision by the Player if these second set of Keno numbers match, and a loss of the bet if they do not match. This embodiment of the Keno number grouping game can be played with any number of Keno numbers in a set. By way of example, TABLE 4A (divided into PARTS 1-4) depicts odds and payouts for five number and ten number embodiments of the game.

Additionally, the game may be played including different numbers or Keno numbers in subsequent sets; for example two Keno numbers in the first set, three Keno numbers in the second set, four Keno numbers in the third set, and five Keno numbers in the final set. TABLE 4B (also divided into PARTS 1-4 depict odds and payouts for matchings of 1-5 numbers in embodiments of the Keno-style game.

TABLE 4A

PART1 Summary of odds and payouts for five number and ten number embodiements of the game played with Keno-like ball objects. (Coloumns O-X and rows 19-36 continued on pp. 65-67 in PARTS 2-4.)

| | A | B | C | D | E | F | G | H | I | J | M |
|---|---|---|---|---|---|---|---|---|---|---|---|
| 1 | | | | | | | PLAYER | | | | |
| 2 | MATCH TYPE | single keno card | | both pick 5 numbers | | | | JS: player and dealer random and player select dealer random match | | | |
| 3 | | pick 5 numbers | | | | | | | | | Odds to 1 |
| 4 | | | | | | | | | | | |
| 5 | Royal Match | 1 number- 80, 60, 40, 20, 10 | possibilities | 80 | | | | | | | |
| 6 | | | win possibilities | 5 | 16 | | | | | | $16.00 |
| 7 | | | | | | | | | | | |
| 8 | Royal Match | 2 numbers- 80, 60; 60, 40; 20, 10 | possibilities | 80 | 79 | 6,320 | | | | | |
| 9 | | | win possibilities | 5 | 4 | 20 | 316 | | | | $316.00 |
| 10 | | | | | | | | | | | |
| 11 | Royal Match | 3 numbers- 80, 60, 40; 60, 40, 20; 40, 20,10 | possibilities | 80 | 79 | 78 | 492,960 | | | | |
| 12 | | | win possibilities | 5 | 4 | 3 | 60 | 8216 | | | $8,216.00 |
| 13 | | | | | | | | | | | |
| 14 | Royal Match | 4 numbers- 80, 60, 40, 20; 60, 40, 20, 10 | possibilities | 80 | 79 | 78 | 77 | 37,957,920 | | | |
| 15 | | | win possibilities | 5 | 4 | 3 | 2 | 120 | 316,316 | | $316,316.00 |
| 16 | | | | | | | | | | | |
| 17 | Royal Match | 5 numbers- 80, 60, 40, 20, 10 | possibilities | 80 | 79 | 78 | 77 | 76 | 2,884,801,920 | | |
| 18 | | | win possibilities | 5 | 4 | 3 | 2 | 1 | 120 | 24,040,016 | $24,040,016.00 |

PART 2. Summary of odds and payouts for five number and ten number embodiments of the game played with Keno-like ball objects. (Continued from PART 1 on p. 64; continued in PARTS 3 and 4 on pp. 66-67.)

| | O | P | Q | R | S | T | U | V | W | X |
|---|---|---|---|---|---|---|---|---|---|---|
| 1 | | | | | | | DEALER | | | |
| 2 | | | | | | | second keno card for dealer | | | |
| 3 | pick 5 numbers | | | | | | dealer | | | Combined Odds for match |
| 4 | | | | | | | | | | |
| 5 | 1 number- 80, 60, 40, 20, 10 | possibilities | 80 | | | | | | | |
| 6 | | win possibilities | 5 | 16 | $16.00 | | | | | $256.00 |
| 7 | | | | | | | | | | |
| 8 | 2 numbers- (80, 60)(60, 40)(20, 10) | possibilities | 80 | 79 | 6,320 | | | | | |

TABLE 4A-continued

| | | | | | | | | | | | |
|---|---|---|---|---|---|---|---|---|---|---|---|
| 9 | | win possibilities | 5 | 4 | 20 | $316.00 | | | | | $99,866 |
| 10 | | | | | | | | | | | |
| 11 | 3 numbers-(80, 60, 4)(60, 40, 20)(40, 20, 10) | possibilities | 80 | 79 | 78 | 492,960 | | | | | |
| 12 | | win possibilities | 5 | 4 | 3 | 60 | $8,216.00 | | | | $67,502,656 |
| 13 | | | | | | | | | | | |
| 14 | 4 numbers-(80, 60, 40, 20)(60, 40, 20, 10) | possibilities | 80 | 79 | 78 | 77 | $37,957,920.00 | | | | |
| 15 | | win possibilities | 5 | 4 | 3 | 2 | 120 | $316,316.00 | | | $100,055,811,856 |
| 16 | | | | | | | | | | | |
| 17 | 5 numbers-(80, 60, 40, 20, 10) | possibilities | 80 | 79 | 78 | 77 | 76 | 2,884,801,920 | | | |
| 18 | | win possibilities | 5 | 4 | 3 | 2 | 1 | 120 | 24,040.016 | | $577,922,369,280,256 |

PART3 Summary of odds and payouts for five number and ten number embodiements of the game played with Keno-like ball objects. (Continued from PARTS 1 and 2 on pp. 64-65; continued in PART 4 on p. 67.)

| | A | B | C | D | E | F | G | H | I | J | M |
|---|---|---|---|---|---|---|---|---|---|---|---|
| 19 | | | | both pick 10 number | | | | | | | |
| 20 | | single keno card | | | | | | | | | |
| 21 | | pick 10 numbers | | | | | Player | | | | Odds to 1 |
| 22 | | | | | | | | | | | |
| 23 | Royal Match | 1 number-80, 60, 40, 20, 10 | possibilities | 80 | | | | | | | |
| 24 | | | win possibilities | 10 | 8 | | | | | | $8.00 |
| 25 | | | | | | | | | | | |
| 26 | Royal Match | 2 numbers-80, 60; 60, 40; 20, 10 | possibilities | 80 | 79 | 6,320 | | | | | |
| 27 | | | win possibilities | 10 | 9 | 90 | 70 | | | | $70.22 |
| 28 | | | | | | | | | | | |
| 29 | Royal Match | 3 numbers-80, 60, 40; 60, 40, 20; 40, 20, 10 | possibilities | 80 | 79 | 78 | 492.960 | | | | |
| 30 | | | win possibilities | 10 | 9 | 8 | 720 | 685 | | | $684.67 |
| 31 | | | | | | | | | | | |
| 32 | Royal Match | 4 numbers-80, 60, 40, 20; 60, 40, 20, 10 | possibilities | 80 | 79 | 78 | 77 | 37,957,920 | | | |
| 33 | | | win possibilities | 10 | 9 | 6 | 7 | 5,040 | 7,531 | | $7,531.33 |
| 34 | | | | | | | | | | | |
| 35 | Royal Match | 5 numbers-80, 60, 40, 20, 10 | possibilities | 80 | 79 | 78 | 77 | 76 | 2,884,801,920 | | |
| 36 | | | win possibilities | 10 | 9 | 6 | 7 | 6 | 30,240 | 95,397 | $95,396.89 |

TABLE 4A-continued

PART4. Summary of odds and payouts for five number and ten number embodiments of the game played with Keno-like ball objects. (Continued from PARTS 1-3 on pp. 64-66.)

| | O | P | Q | R | S | T | U | V | W | X |
|---|---|---|---|---|---|---|---|---|---|---|
| 19 | | | | | | | | | | |
| 20 | | | | | | | | | | |
| 21 | second keno card for dealer | pick 10 numbers | | | | | dealer | | | Combined Odds for match |
| 22 | | | | | | | | | | |
| 23 | 1 number- 80, 60, 40, 20, 10 | possibilities | 80 | | | | | | | |
| 24 | | win possibilities | 10 | 8 | $8.00 | | | | | $64.00 |
| 25 | | | | | | | | | | |
| 26 | 2 numbers- (80, 60)(60, 40)(20, 10) | possibilities | 80 | 79 | 6,320 | | | | | |
| 27 | | win possibilities | 10 | 9 | 90 | $70 | | | | $4,931.16 |
| 28 | | | | | | | | | | |
| 29 | 3 numbers- (80, 60, 40)(60, 40, 20)(40, 20, 10) | possibilities | 80 | 79 | 78 | 492,960 | | | | |
| 30 | | win possibilities | 10 | 9 | 8 | 720 | 685 | | | $468,768.44 |
| 31 | | | | | | | | | | |
| 32 | 4 numbers- (80, 60, 40, 20) (60, 40, 20, 10) | possibilities | 80 | 79 | 78 | 77 | $37,957,920 | | | |
| 33 | | win possibilities | 10 | 9 | 8 | 7 | 5,040 | $7,531.33 | | $56,720,981.78 |
| 34 | | | | | | | | | | |
| 35 | 15 numbers- (80, 60, 40, 20, 10) | possibilities | 80 | 79 | 78 | 77 | 76 | 2,884,801,920 | | |
| 36 | | win possibilities | 10 | 9 | 8 | 7 | 6 | 30,240 | 95,397 | $9,100,566,409.68 |

TABLE 4B

PART 1. Summary of odds and payouts for matches of 1-5 number matching embodiments of the game played with Keno-like ball objects. (Columns O-X and rows 19-36 continued on pp. 69-71 in PARTS 2-4.)

| | A | B | C | D | E | F | G | H | I | J | M |
|---|---|---|---|---|---|---|---|---|---|---|---|
| 1 | | | | | | PLAYER | | | | | |
| 39 | MATCH TYPE | | player pick 1 and match any 1 | | | | | | | 1 | |
| 40 | | | | | | | | | | | $1.00 |
| 41 | match one number | | | | | | | | | 1 | |
| 42 | | | | | | | | | | | $1.00 |
| 43 | | | | | | | | | | 1 | |
| 44 | | | | | | | | | | | $1.00 |
| 45 | | | | | | | | | | 1 | |
| 46 | | | | | | | | | | | $1.00 |
| 47 | | | | | | | | | | | |
| 48 | | | player pick 2 match any 2 | | | | | | | | |
| 49 | | | | | | | | | | 1 | $1.00 |
| 50 | | | | | | | | | | | |
| 51 | match 2 numbers | | | | | | | | | 1 | $1.00 |
| 52 | | | | | | | | | | | |
| 53 | | | | | | | | | | 1 | $1.00 |
| 54 | | | | | | | | | | | |
| 55 | | | | | | | | | | 1 | $1.00 |

PART 2. Summary of odds and payouts for matches of 1-5 number matching embodiments of the game played with Keno-like ball objects. (Continued from PART 1 on p. 68; continued in PARTS 3 and 4 on pp. 70-71.)

| | O | P | Q | R | S | T | U | V | W | X |
|---|---|---|---|---|---|---|---|---|---|---|
| 1 | | | | | | DEALER | | | | |
| 39 | dealer picks 1 number | possibilities | 80 | | | | | | | |
| 40 | | win possibilities | 1 | 80 | | | | | | $80.00 |
| 41 | dealer picks 5 numbers | possibilities | 80 | | | | | | | |
| 42 | | win possibilities | 5 | 16 | | | | | | $16.00 |
| 43 | dealer pick 10 numbers | possibilities | 80 | | | | | | | |
| 44 | | win possibilities | 10 | 8 | | | | | | $8.00 |
| 45 | dealer pick 20 numbers | possibilities | 80 | | | | | | | |
| 46 | | win possibiliites | 20 | 4 | | | | | | $4.00 |
| 47 | | | | | | | | | | |
| 48 | dealer picks 2 numbers | possibilities | 80 | 79 | 6320 | | | | | |
| 49 | | win possibilities | 1 | 1 | 1 | $6,320 | | | | $6,320 |
| 50 | dealer picks 5 numbers | possibilities | 60 | 79 | 6320 | | | | | |
| 51 | | win possibilities | 5 | 4 | 20 | $316.00 | | | | $316 |
| 52 | dealer pick 10 numbers | possibilities | 80 | 79 | 6320 | | | | | |
| 53 | | win possibilities | 10 | 9 | 90 | $70.22 | | | | $70.22 |
| 54 | dealer pick 20 numbers | possibilities | 60 | 79 | 6320 | | | | | |
| 55 | | win possibilities | 20 | 19 | 380 | $16.63 | | | | $16.63 |

TABLE 4B-continued

PART 3. Summary of odds and payouts for matches of 1-5 number matching embodiments of the game played with Keno-like ball objects. (Continued from PARTS 1 and 2 on pp. 68-69; continued in PART 4 on p. 71.)

| | A | B | C | D | E | F | G | H | I | J | M |
|---|---|---|---|---|---|---|---|---|---|---|---|
| 56 | | | player pick 3 and match any 3 | | | | | | | | |
| 57 | | | | | | | | | | 1 | $1.00 |
| 58 | | | | | | | | | | | |
| 59 | match 3 numbers | | | | | | | | | 1 | $1.00 |
| 60 | | | | | | | | | | | |
| 61 | | | | | | | | | | 1 | $1.00 |
| 62 | | | | | | | | | | | |
| 63 | | | | | | | | | | 1 | $1.00 |
| 64 | | | player pick 4 and match any 4 | | | | | | | | |
| 65 | | | | | | | | | | 1 | $1.00 |
| 66 | match 4 numbers | | | | | | | | | | |
| 67 | | | | | | | | | | 1 | $1.00 |
| 68 | | | | | | | | | | | |
| 69 | | | | | | | | | | 1 | $1.00 |
| 70 | | | | | | | | | | | |
| 71 | | | | | | | | | | 1 | $1.00 |
| 72 | | | player pick 5 match any 5 | | | | | | | | |
| 73 | | | | | | | | | | 1 | $1.00 |
| 74 | | | | | | | | | | | |
| 75 | match 5 numbers | | | | | | | | | 1 | $1.00 |
| 76 | | | | | | | | | | | |
| 77 | | | | | | | | | | 1 | $1.00 |

PART 4. Summary of odds and payouts for matches of 1-5 number matching embodiments of the game played with Keno-like ball objects. (Continued from PARTS 1-3 on pp. 68-70.)

| | O | P | Q | R | S | T | U | V | W | X |
|---|---|---|---|---|---|---|---|---|---|---|
| 56 | dealer picks 3 numbers | possibilities | 80 | 79 | 78 | 492960 | | | | |
| 57 | | win possibilities | 3 | 2 | 1 | 6 | $82,160.00 | | | $82,160 |
| 58 | dealer picks 5 numbers | possibilities | 80 | 79 | 78 | 492,960 | | | | |
| 59 | | win possibilities | 5 | 4 | 3 | 60 | $8,216.00 | | | $8,216 |
| 60 | dealer pick 10 numbers | possibilities | 80 | 79 | 78 | 492,960 | | | | |
| 61 | | win possibilities | 10 | 9 | 8 | 720 | $684.67 | | | $684.67 |
| 62 | dealer pick 20 numbers | possibilities | 80 | 79 | 78 | 492,960 | | | | |
| 63 | | win possibilities | 20 | 19 | 18 | 6840 | $72.07 | | | $72.07 |
| 64 | dealer pick 4 numbers | possibilities | 80 | 79 | 78 | 77 | 37957920 | | | |
| 65 | | win possibilities | 4 | 3 | 2 | 1 | 24 | $1,581,580.00 | | $1,581,580 |
| 66 | dealer pick 5 numbers | possibilities | 80 | 79 | 78 | 77 | 37957920 | | | |
| 67 | | win possibilities | 5 | 4 | 3 | 2 | 120 | $316,316.00 | | $316,316 |
| 68 | dealer pick 10 numbers | possibilities | 80 | 79 | 78 | 77 | 37957920 | | | |
| 69 | | win possibilities | 10 | 9 | 8 | 7 | 5040 | $7,531.33 | | $7,531.33 |
| 70 | dealer pick 20 numbers | possibilities | 80 | 79 | 78 | 77 | 37957920 | | | |
| 71 | | win possibilities | 20 | 19 | 18 | 17 | 116280 | $326.44 | | $326.44 |
| 72 | dealer pick 5 numbers | possibilities | 80 | 79 | 78 | 77 | 76 | 2,884,801,920 | | |

TABLE 4B-continued

| | | | | | | | | | | |
|---|---|---|---|---|---|---|---|---|---|---|
| 73 | | win possibilities | 5 | 4 | 3 | 2 | 1 | 120 | $24,040,016 | $24,040,016 |
| 74 | dealer pick 10 numbers | possibilities | 80 | 79 | 78 | 77 | 76 | 2,884,801,920 | | |
| 75 | | win possibilities | 10 | 9 | 6 | 7 | 6 | 30240 | $95,396.89 | $95,396.89 |
| 76 | dealer pick 20 numbers | possibilities | 80 | 79 | 78 | 77 | 76 | 2,884,801,920 | | |
| 77 | | win possibilities | 20 | 19 | 18 | 17 | 16 | 1860480 | $1,550.57 | $1,550.57 |

Exemplary Embodiment—Rotating Selector Versions of Player Decline-or-Accept Game In one aspect of the instant game of chance, the random selection of objects may be performed using rotatable wheels or rotatable discs, similar to the manner described in the aforementioned U.S. Provisional Patent Application No. 62/182,100. This embodiment of the game may be considered as a "slot machine"-like version of the game. In operation of the game, in one exemplary embodiment, a Player may be provided with a first rotatable wheel machine depicting a first collection of objects on the wheels thereof, and a Dealer may be provided with a second rotatable wheel machine depicting a second collection of objects on the wheels thereof. The Player's collection of objects is comprised of at least the same collection of objects as the Dealer's collection of objects. The game proceeds by the Player operating his machine to make a random selection of objects displayed on the faces of the wheels. A determination is then made as to whether there is a match of the Player's randomly selected objects with objects that are predetermined to be of high quality. Alternatively, the Dealer may operate his machine to make a random selection of objects. A determination is made as to whether the Player's objects match the Dealer's objects. In the event of a match in either embodiment of the game, the House pays funds to the Player, the quantity of which is determined by the probability of the match as described previously herein for other embodiments of the game. Additionally, if there is a match of sufficiently high quality, the House may offer the Player the "Deal/No Deal" Options A and B described previously. Play may continue with a sequence of Option A/Option B scenarios, until the Player loses, or the Player wins the maximum jackpot.

Exemplary Embodiment—Polyhedra Versions of Player Decline-or-Accept Game

In one aspect of the instant game of chance, the random selection of objects may be performed using polyhedra, in a manner similar to that described in the aforementioned U.S. Provisional Patent Application No. 62/182,100. In operation of the game, in one exemplary embodiment, a Player may be provided with a first set of polyhedra, the facets of which represent objects, and a Dealer may be provided with a second set of polyhedra. The Player's collection of objects is comprised of at least the same collection of objects as the Dealer's collection of objects. The game proceeds by the Player casting or fluidizing his collection of polyhedra to make a random selection of objects on the facets thereof. A determination is then made as to whether there is a match of the Player's randomly selected objects with objects that are predetermined to be of high quality. Alternatively, the Dealer may cast or fluidize his collection of polyhedra to make a random selection of objects on the facets thereof. A determination is made as to whether the Player's objects match the Dealer's objects. In the event of a match in either embodiment of the game, the House pays funds to the Player, the quantity of which is determined by the probability of the match as described previously herein for other embodiments of the game. Additionally, if there is a match of sufficiently high quality, the House may offer the Player the "Deal/No Deal" Options A and B described previously. Play may continue with a sequence of Option A/Option B scenarios, until the Player loses, or the Player wins the maximum jackpot.

It is therefore apparent that there has been provided, in accordance with the present disclosure, matching games of chance that are embodied as card games, or matching games using other objects. Having thus described the basic concept of the invention, it will be apparent to those skilled in the art that the foregoing detailed disclosure is intended to be presented by way of example only, and is not limiting. Various alterations, improvements, and modifications will occur to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed gaming methods to any order except as may be expressly stated in the claims.

What is claimed is:

1. A gaming method comprising:

a) defining collections of ball objects to be used in playing a game according to the method, each of the ball objects marked with one of a number, letter, or symbol;

b) assigning a first collection of the ball objects contained in a first fluidizing chamber to a dealer party, and a second collection of the ball objects contained in a second fluidizing chamber to a first wagering party, the second collection of ball objects comprising at least the same objects as the first collection of ball objects;

c) accepting a first wager of funds of a defined value from the first wagering party, the wager contingent upon the outcome of random selections of ball objects from the first and second collections of ball objects;

d) causing the first collection of ball objects to be fluidized, and causing a random selection of a subset of the ball objects of the first collection, wherein the subset of the ball objects of the first collection is exhausted from the first fluidizing chamber, by a first fluid flow through the first fluidizing chamber;

e) and causing the second collection of ball objects to be fluidized, and causing a random selection of a subset of the ball objects of the second collection, wherein the subset of the ball objects of the second collection is exhausted from the second fluidizing chamber, by a second fluid flow through the second fluidizing chamber; and f) comparing the subset of the ball objects of the first collection exhausted from the first fluidizing chamber with the subset of the ball objects of the second collection exhausted from the second fluidizing chamber; and if the subset of the ball objects of the first collection exhausted from the first fluidizing chamber does not correspond to one of a predefined set of matching relationships with the subset of the ball objects of the second collection exhausted from the second fluidizing chamber, transferring the defined value of the wager to the dealer party; and if the subset of the ball objects of the first collection exhausted from the first fluidizing chamber has a matching relationship to the subset of the ball objects of the second collection exhausted from the second fluidizing chamber, transferring a payout of X times the defined value of the funds of the wager from the dealer party to the first wagering party, wherein X is a function of the probability of occurrence of the corresponding one of the predefined set of matching relationships.

2. The method of claim 1, further comprising:

a) assigning an additional collection of the ball objects contained in an additional fluidizing chamber to each one of additional wagering parties, the additional collections of the ball objects each comprising at least the same objects as the first collection of ball objects;

b) accepting wagers of funds of defined values from each of the additional wagering parties, the wagers contingent upon the outcome of random selections of ball objects from the first and additional collections of ball objects;

c) causing each additional collection of ball objects to be fluidized in its respective fluidizing chamber and causing a random selection of a subset of the ball objects from each of the additional collections of ball objects by fluid flow through the respective fluidizing chamber;

d) comparing the subset of ball objects from the first collection of ball objects with the each of the subsets of ball objects from each of the additional collections of ball objects;

e) for each one of the additional wagering parties, if the subset of objects from the first collection of ball objects does not correspond to one of the predefined set of matching relationships with the subset of objects from the additional collection of ball objects assigned to that wagering party, transferring the defined value of the wager of funds of that additional party to the dealer party;

f) for each one of the additional wagering parties, if the subset of objects from the first collection of ball objects has a matching relationship to the subset of objects from the additional collection of objects assigned to that wagering party that corresponds to one of the predefined set of relationships, transferring the funds payout of X times the defined value of the wager of funds of that additional wagering party from the dealer party to that additional wagering party.

3. The method of claim 2, further comprising:

a) determining if the subset of ball objects from the first collection of objects corresponds to a lowest probability of occurrence matching relationship with the subset of ball objects from the second collection of ball objects or with the respective subsets of any of the additional collections of ball objects;

b) for the first wagering party, if the subset of ball objects from the first collection of ball objects does not correspond to the lowest probability of occurrence matching relationship with the subset of ball objects from the second collection of ball objects, transferring a portion of the defined value of the first wager of funds to a bonus funds pool operated by the dealer party, the bonus funds pool available for payment to any wagering party engaged in the gaming method following the transferring the portion the defined value of the wager to the bonus funds pool;

c) for each one of the additional wagering parties, if the subset of ball objects from the first collection of ball objects does not correspond to the lowest probability of occurrence matching relationship with the subset of ball objects from the collection of ball objects assigned to that wagering party, transferring a portion of the defined value of the wager of funds of that party to the bonus funds pool;

d) for the first wagering party, if the subset of ball objects from the first collection of ball objects corresponds to the lowest probability of occurrence matching relationship with the subset of ball objects from the second collection of ball objects, transferring the funds in the bonus funds pool to the first wagering party;

e) for each one of the additional wagering parties, if the subset of ball objects from the first collection of ball objects corresponds to the lowest probability of occurrence matching relationship with the subset of ball objects from the collection of ball objects assigned to that wagering party, transferring the funds in the bonus funds pool to that wagering party; and f) if the subset of ball objects from the first collection of ball objects corresponds to the lowest probability of occurrence matching relationship with subsets of ball objects from respective collections of ball objects assigned to a plurality of wagering parties, transferring a 1/Y share of the funds in the bonus funds pool to each wagering party whose subsets of ball objects have the lowest probability of occurrence matching relationship with the subset of ball objects from the first collection of ball objects, where Y is the number of wagering parties whose subsets of ball objects have the lowest probability of occurrence matching relationship with the subset of ball objects from the first collection of objects.

4. The method of claim 2, wherein the dealer party accepts the first wager of funds of the first wagering party located at a first location, and accepts the wager of funds of at least one of the additional wagering parties located at a second location different from the first location.

5. The method of claim 2, wherein the dealer party accepts the first wager of funds of the first wagering party on a physical gaming surface, and accepts the wager of funds of at least one of the additional wagering parties via a user interface device in communication with a computer.

6. The method of claim 2, wherein at least one of the additional collections of ball objects and additional fluidizing chamber containing the at least one additional collection are virtual ball objects and a virtual fluidizing chamber defined using three dimensional modeling software executed by a computer.

7. The method of claim 6, wherein a fluid flow to fluidize the virtual ball objects in the virtual fluidizing chamber is a virtual fluid flow simulated using computational fluid dynamics software.

8. The method of claim 1, wherein the first collection of ball objects, the second collection of ball objects, the first fluidizing chamber, and the second fluidizing chamber are virtual ball objects defined using three dimensional modeling software executed by a computer, and the first and second fluid flows are virtual fluid flows simulated using computational fluid dynamics software.

9. The method of claim 1, wherein the first collection of ball objects are marked with indicia corresponding to values and to suits of spades, diamonds, clubs, and hearts of standard playing cards, each of the ball objects of the first collection having a combination of value and suit corresponding to a unique playing card, and wherein the second collection of ball objects includes at least a set of ball objects identical to the ball objects of the first collection.

10. The method of claim 1, wherein the ball objects of the first collection and the ball objects of the second collection are regular polyhedral ball objects, each of the regular polyhedral ball objects comprising a plurality of exterior facets.

11. The method of claim 10, wherein the facets of the regular polyhedral ball objects of the first collection of ball objects are marked with indicia corresponding to values and to suits of spades, diamonds, clubs, and hearts of standard playing cards, each of the facets of the regular polyhedral ball objects of the first collection having a combination of value and suit corresponding to a unique playing card, and wherein the second collection of ball objects includes at least a set of ball objects identical to the ball objects of the first collection.

* * * * *